US008056352B2

(12) United States Patent
Kang et al.

(10) Patent No.: US 8,056,352 B2
(45) Date of Patent: Nov. 15, 2011

(54) MULTIPLE DISCHARGE PORT INDOOR UNIT OF AIR CONDITIONER

(75) Inventors: Dong-Woon Kang, Changwon-si (KR); Yong-Taeg Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 695 days.

(21) Appl. No.: 11/795,982

(22) PCT Filed: Jan. 23, 2006

(86) PCT No.: PCT/KR2006/000255

§ 371 (c)(1),
(2), (4) Date: May 6, 2008

(87) PCT Pub. No.: WO2006/080793

PCT Pub. Date: Aug. 3, 2006

(65) Prior Publication Data

US 2008/0302120 A1 Dec. 11, 2008

(30) Foreign Application Priority Data

Jan. 27, 2005 (KR) ..... 10-2005-0007675
Dec. 22, 2005 (KR) ..... 10-2005-0127965
Dec. 28, 2005 (KR) ..... 10-2005-0131784

(51) Int. Cl.
*F25D 23/12* (2006.01)
*F25D 19/00* (2006.01)
*A47B 77/08* (2006.01)

(52) U.S. Cl. ..... 62/259.1; 62/298; 312/236

(58) Field of Classification Search ..... None
See application file for complete search history.

(56) References Cited

U.S. PATENT DOCUMENTS 3,174,541 A * 3/1965 Brandt et al. ..... 165/122
3,950,835 A * 4/1976 Bennink et al. ..... 29/888.025
4,118,083 A * 10/1978 Lackey et al. ..... 312/100
4,449,376 A * 5/1984 Draper et al. ..... 62/259.1
4,554,796 A * 11/1985 Stankard ..... 62/326
4,683,942 A * 8/1987 Bierkamp et al. ..... 165/53
5,377,503 A * 1/1995 Reedy et al. ..... 62/326
5,685,166 A * 11/1997 Li ..... 62/428
5,987,908 A * 11/1999 Wetzel ..... 62/259.1
6,044,657 A * 4/2000 Nakanuma et al. ..... 62/259.1
6,098,416 A * 8/2000 Addington et al. ..... 62/298
6,101,829 A * 8/2000 Robinson ..... 62/259.1

(Continued)

FOREIGN PATENT DOCUMENTS

EP 1 041 351 10/2000
JP 01-227770 9/1989
JP 10-141741 5/1998
JP 10-197001 7/1998
JP 2001-289456 10/2001
KR 10-2005-0099352 A 10/2005

*Primary Examiner* — Frantz Jules
*Assistant Examiner* — Lukas Baldridge
(74) *Attorney, Agent, or Firm* — McKenna Long & Aldridge LLP

(57) ABSTRACT

An indoor unit of an air conditioner is provided. The indoor unit includes a cabinet, a heat exchanger, and at least one ventilation unit. The cabinet includes a plurality of discharge ports formed on different surfaces thereof. The heat exchanger is installed in one side of the cabinet. The ventilation unit is installed inside the cabinet and includes a discharge port selectively communicating with one of the plurality of discharge ports of the cabinet.

34 Claims, 18 Drawing Sheets

U.S. PATENT DOCUMENTS 6,112,546 A * 9/2000 Kim ..... 62/440
6,360,813 B1 * 3/2002 Katoh et al. ..... 165/104.33
6,591,628 B2 * 7/2003 Mochizuki et al. ..... 62/288
6,651,454 B1 * 11/2003 Spiegel ..... 62/259.1
2002/0112495 A1 * 8/2002 Campbell ..... 62/259.1
2003/0094010 A1 * 5/2003 Katatani et al. ..... 62/259.1
2003/0164653 A1 * 9/2003 Yasuda ..... 310/90
2004/0221605 A1 * 11/2004 Chae et al. ..... 62/259.2

* cited by examiner

[Fig. 1]
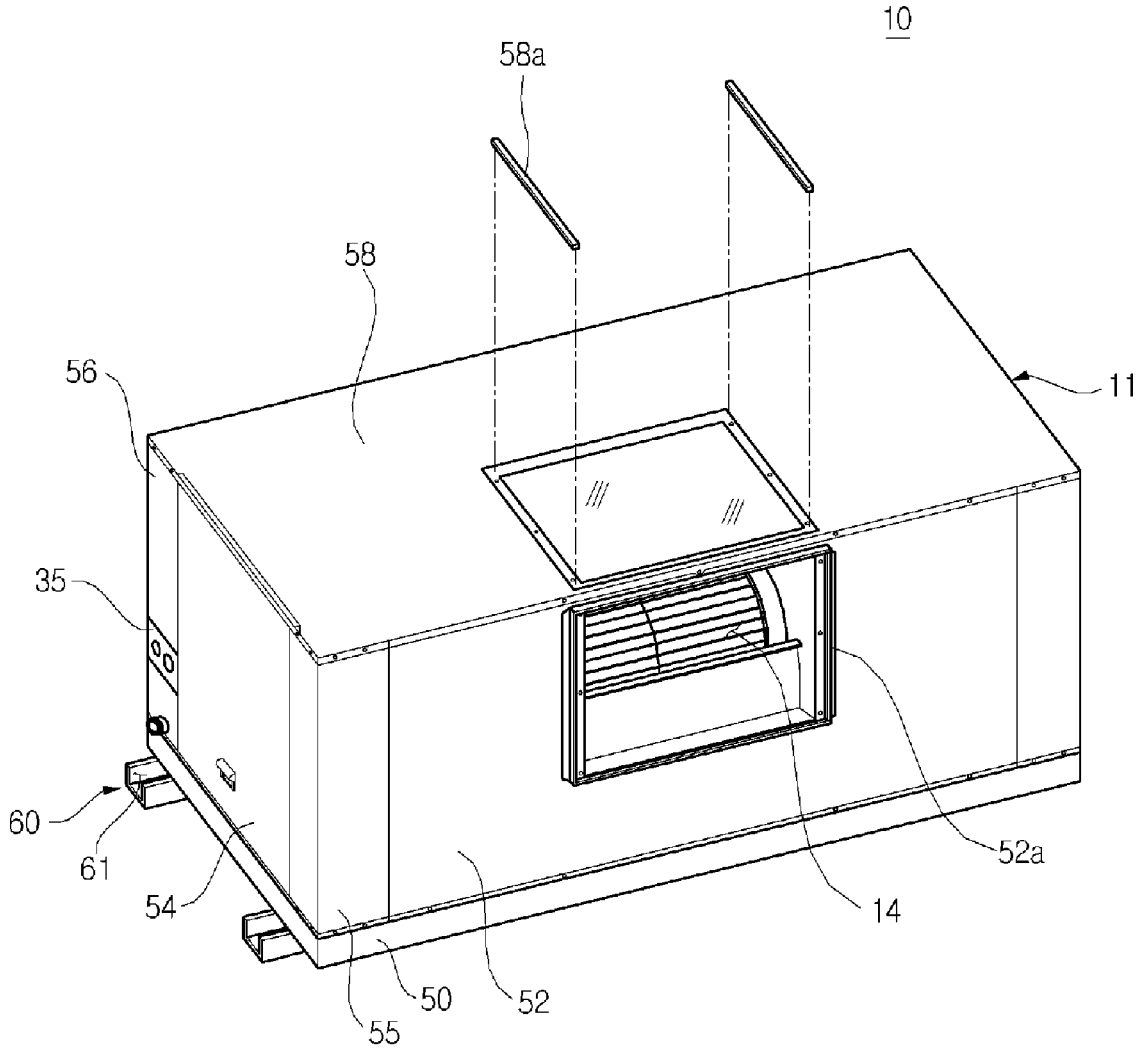

[Fig. 2]
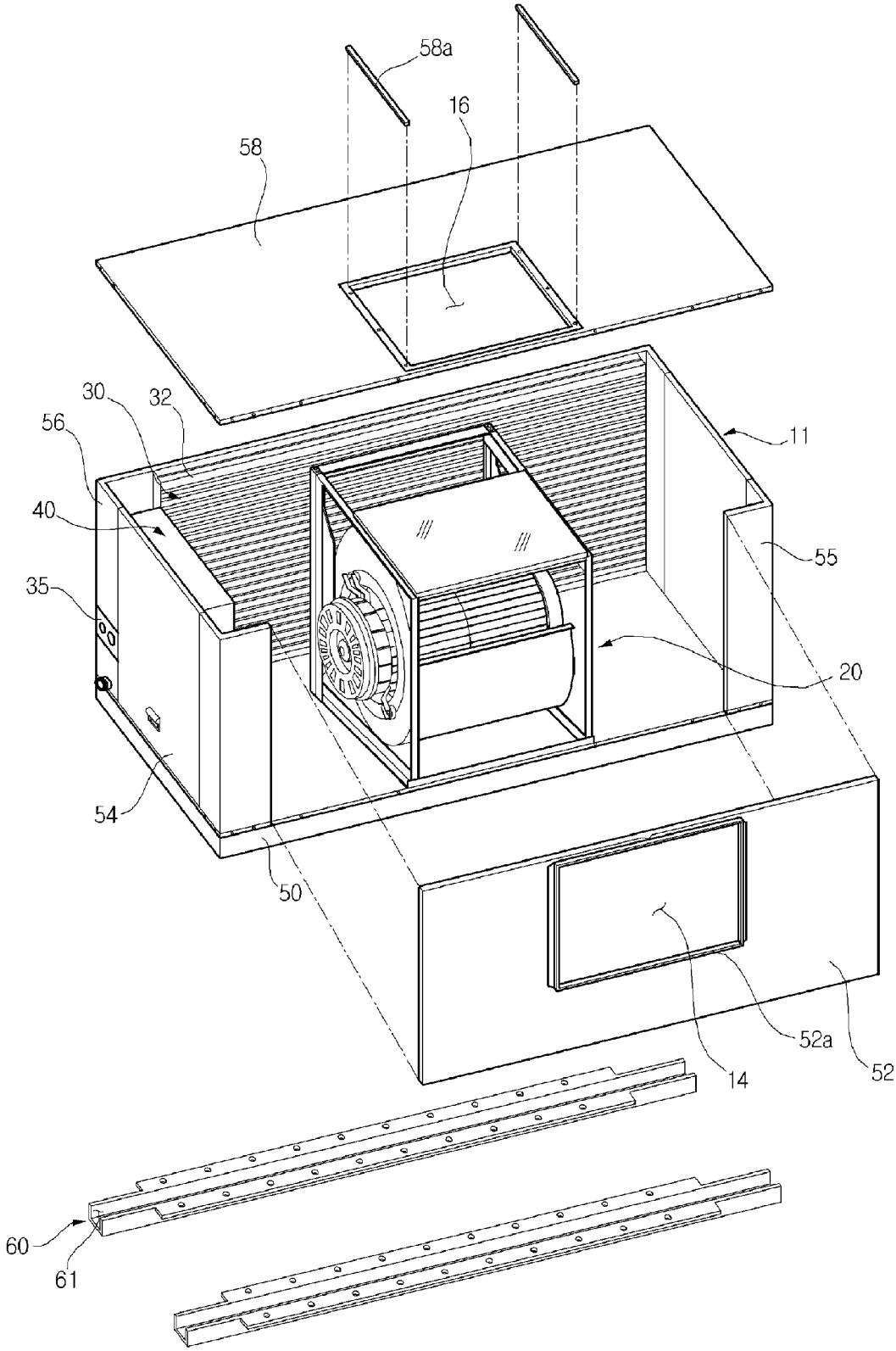

[Fig. 3]
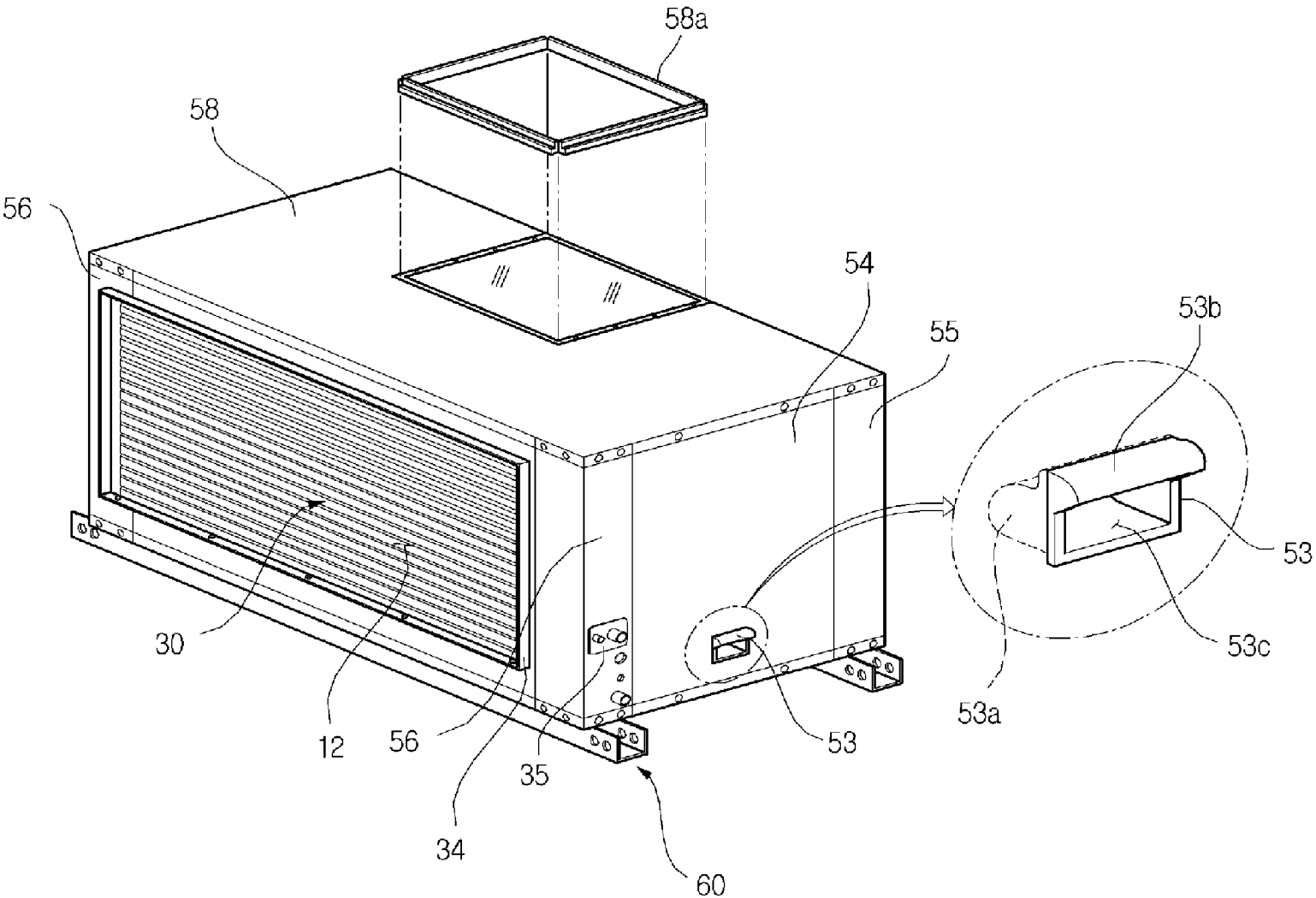

[Fig. 4]
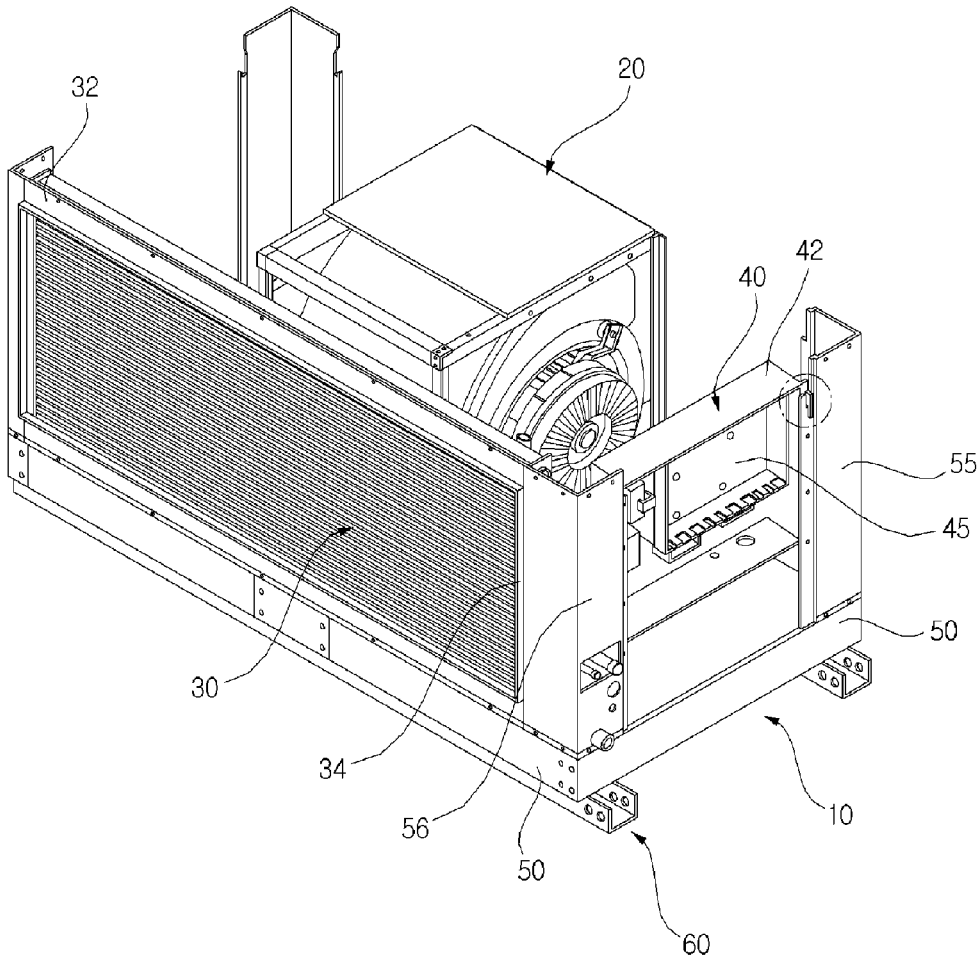
[Fig. 5]
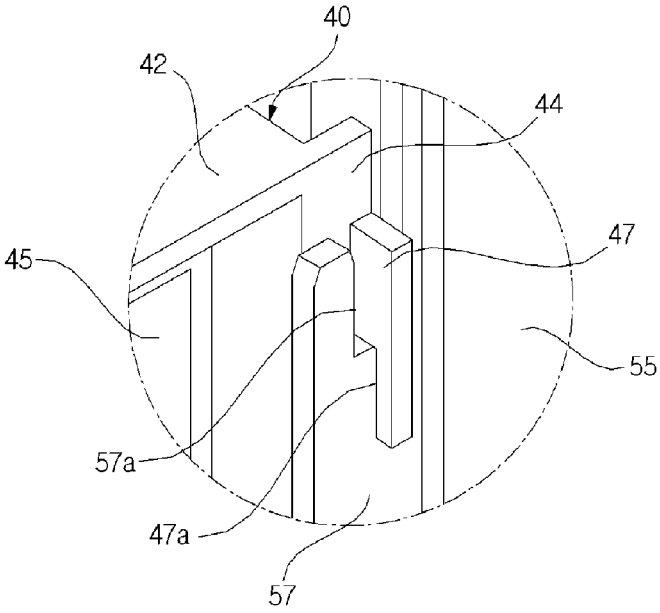

[Fig. 6]
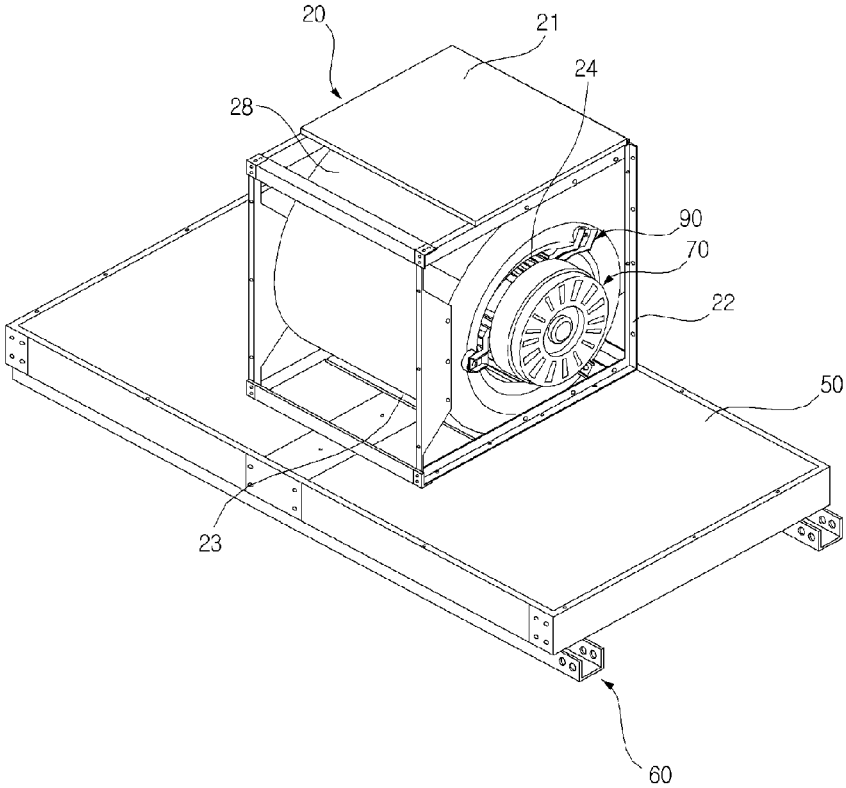
[Fig. 7]
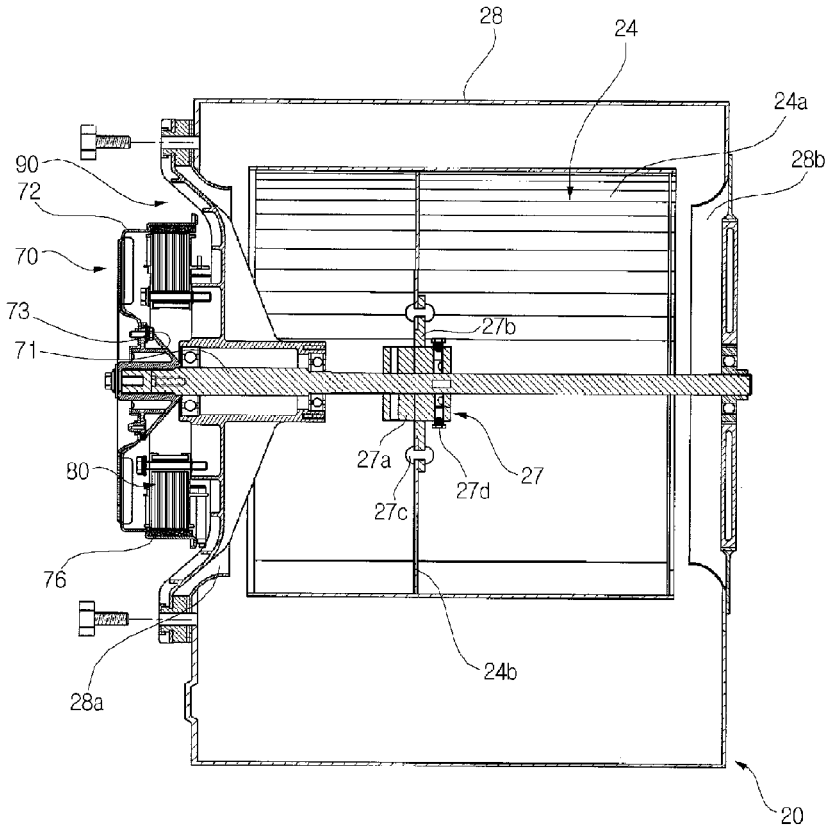

[Fig. 8]
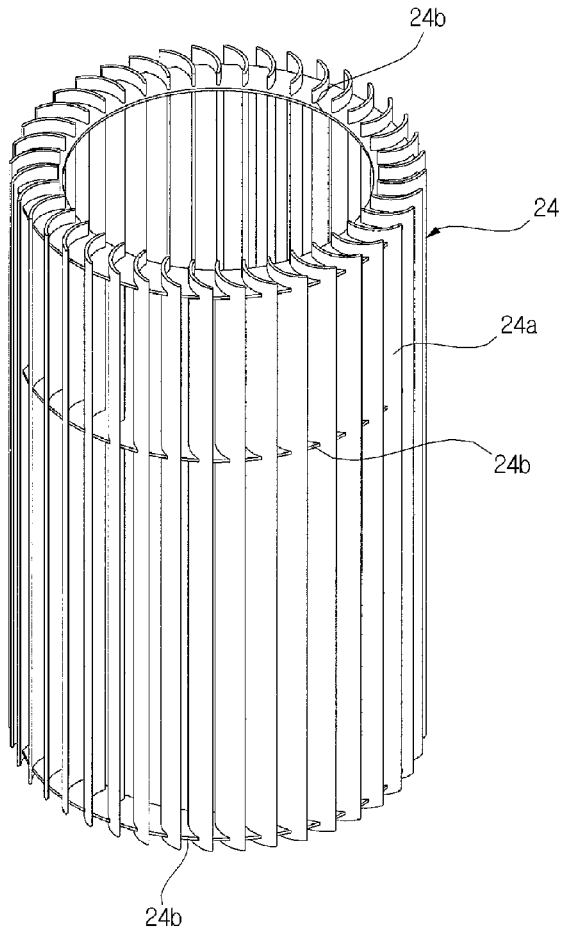
[Fig. 9]
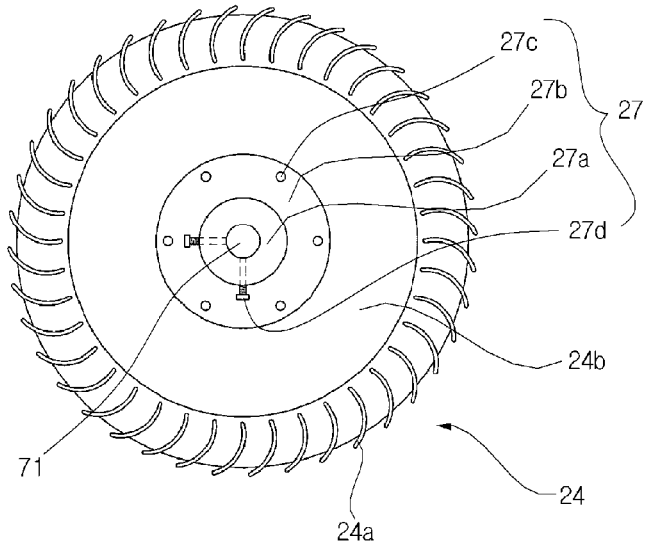

[Fig. 10]
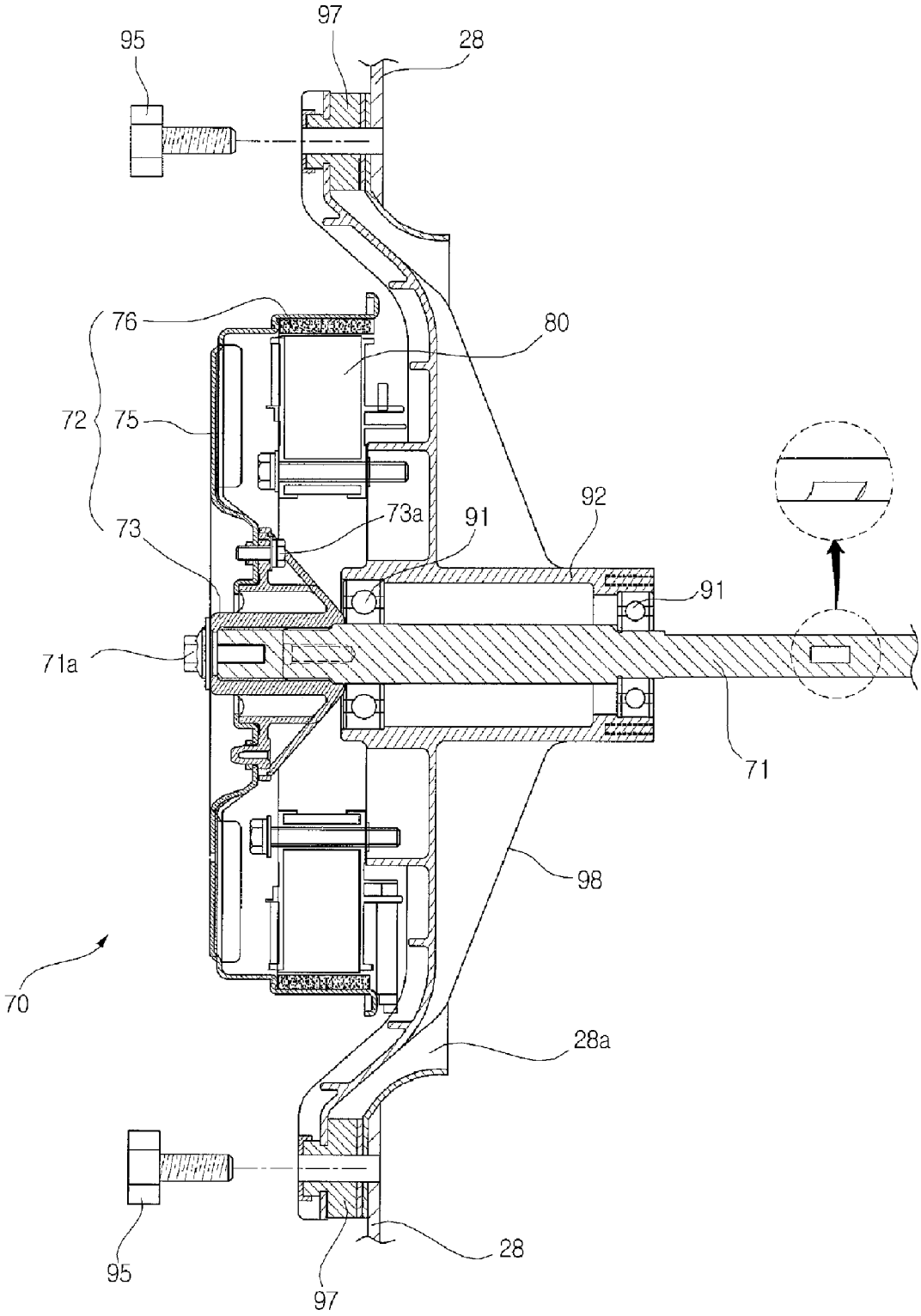

[Fig. 11]
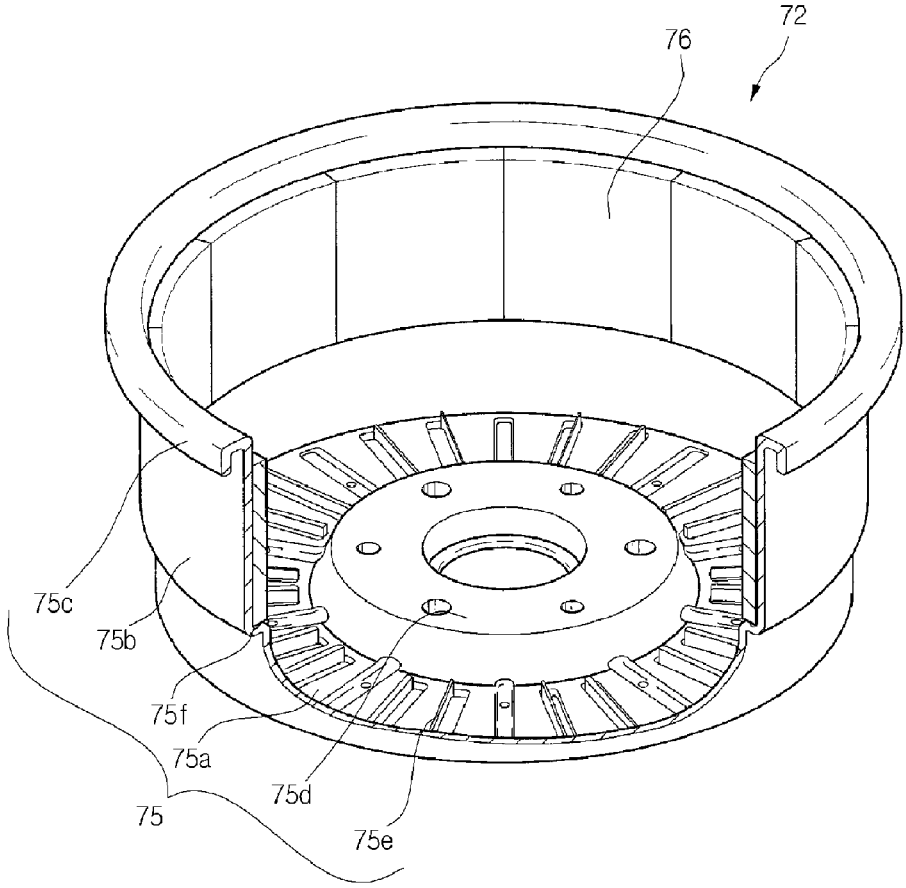
[Fig. 12]
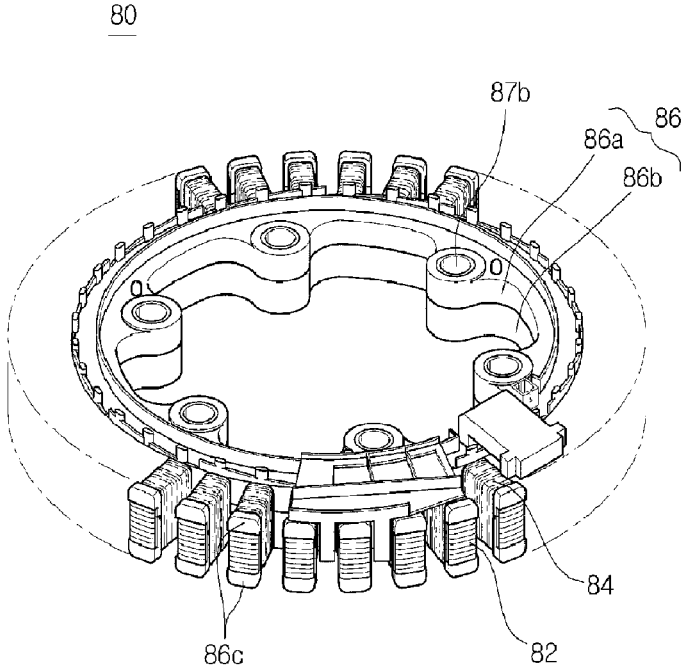

[Fig. 13]
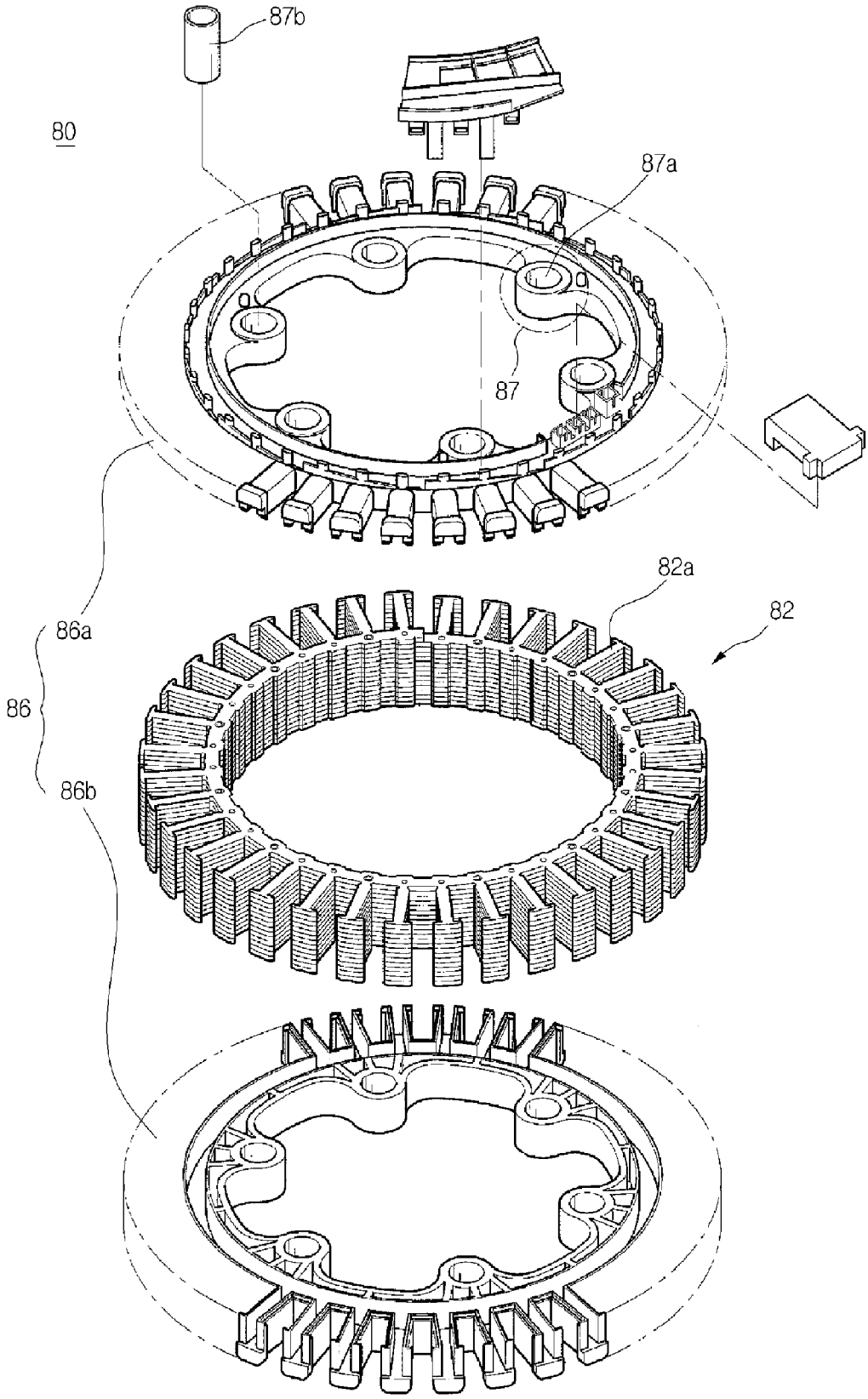

[Fig. 14]
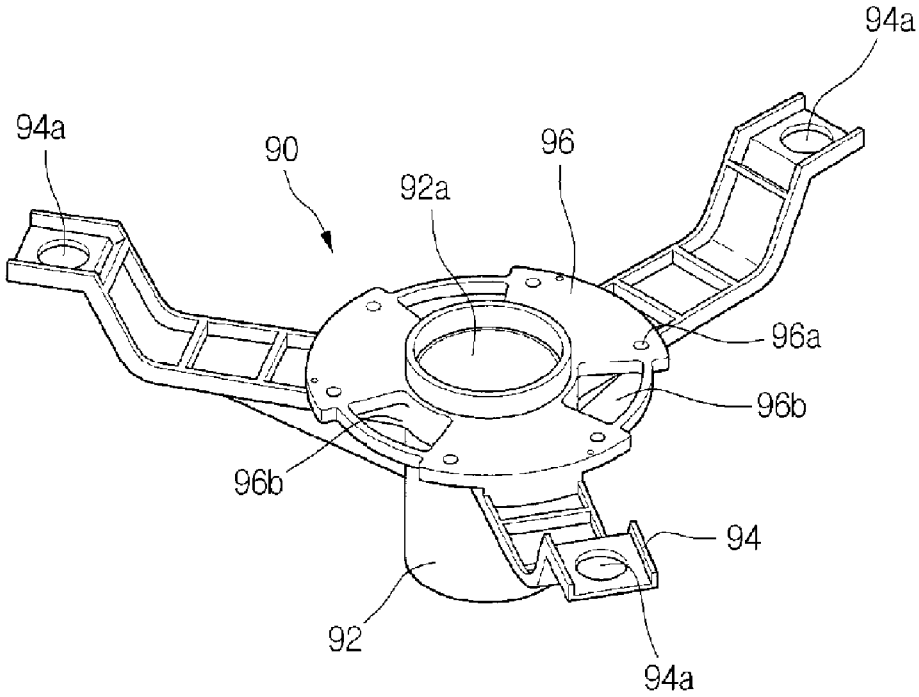
[Fig. 15]
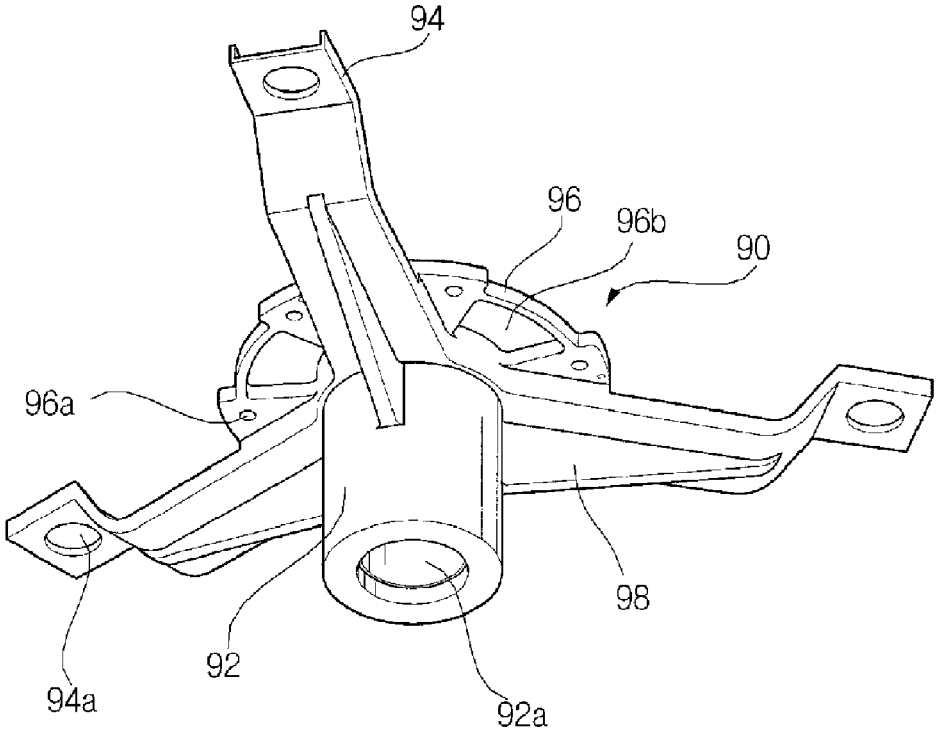

[Fig. 16]
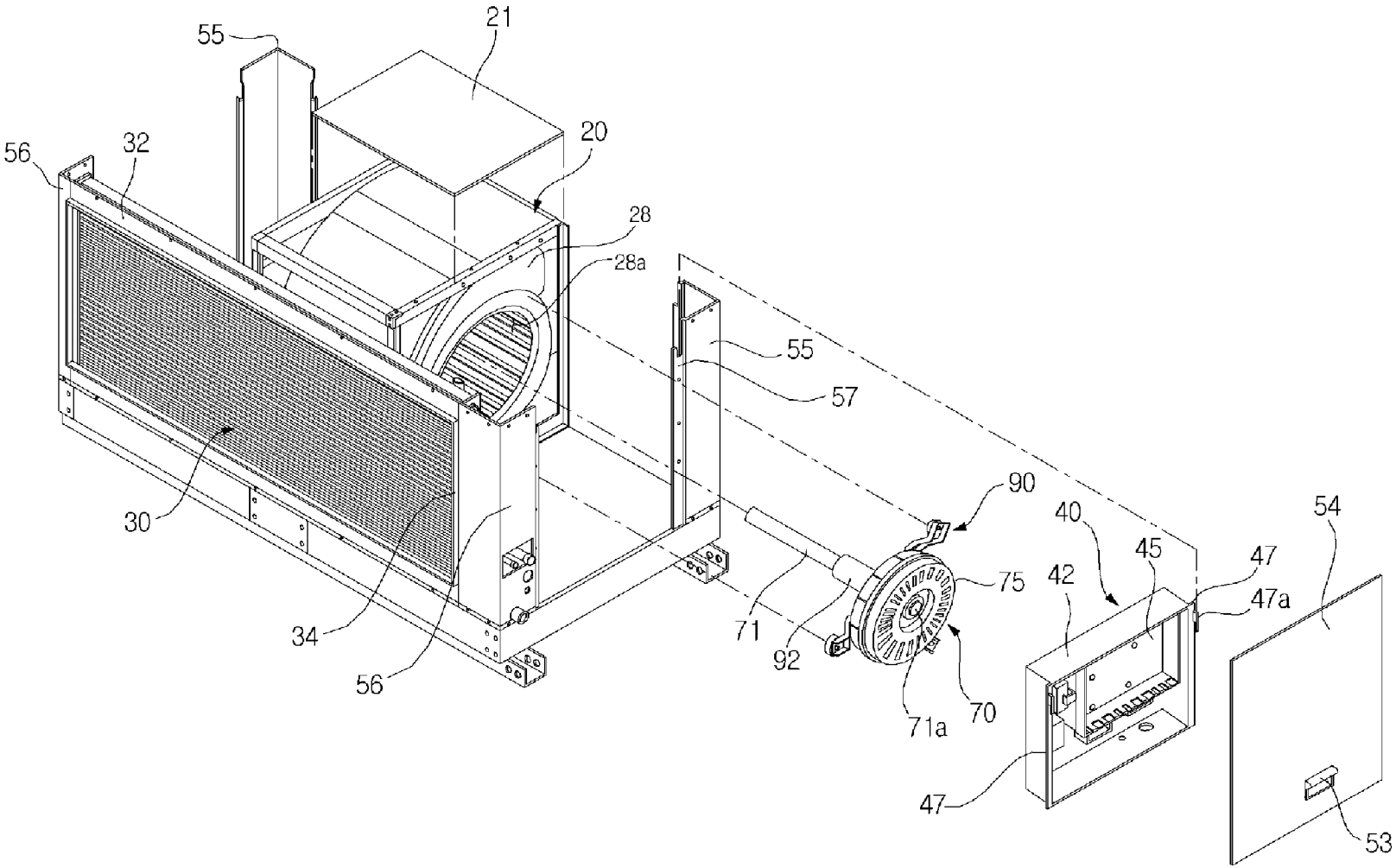

[Fig. 17]
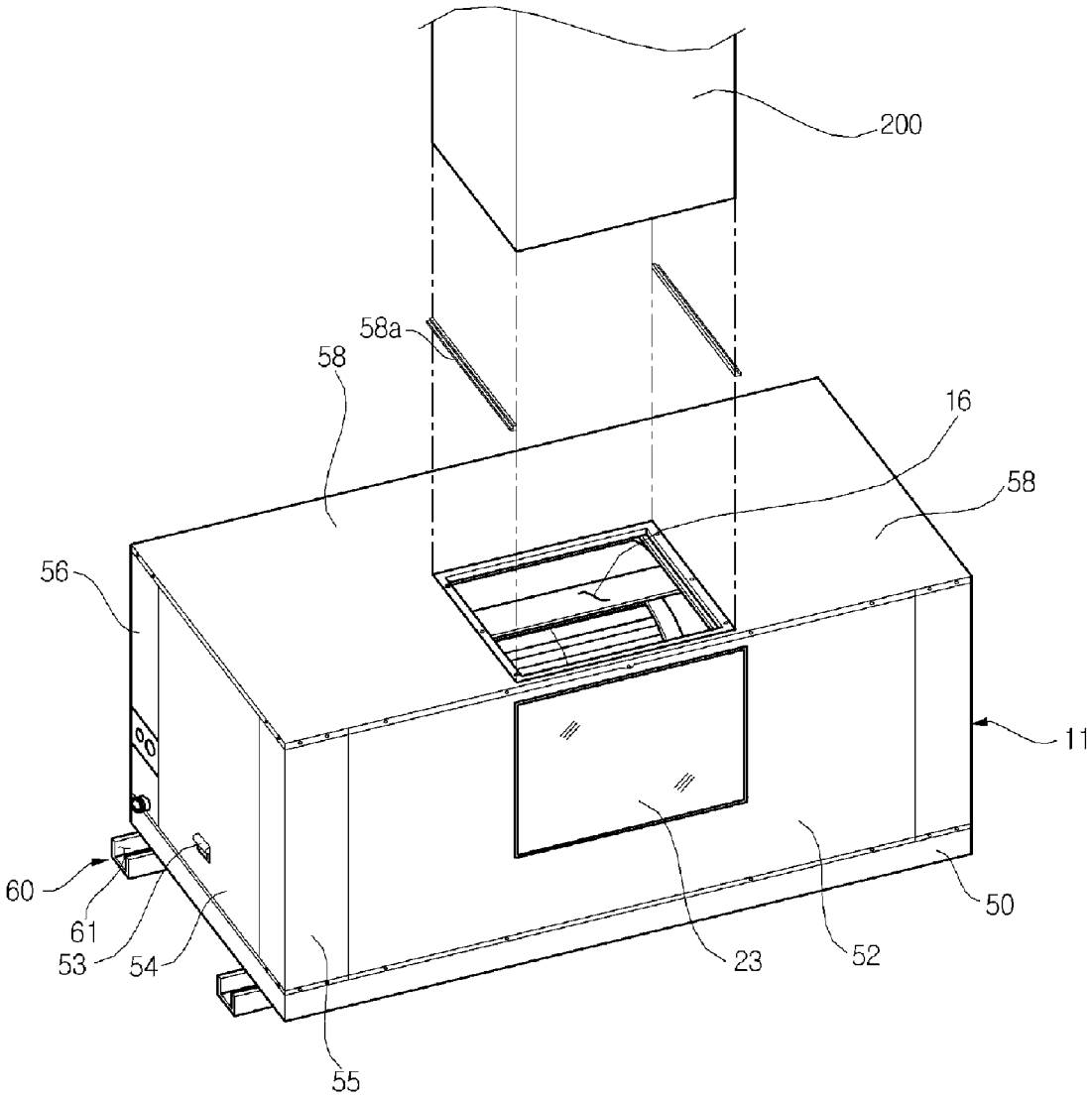

[Fig. 18]
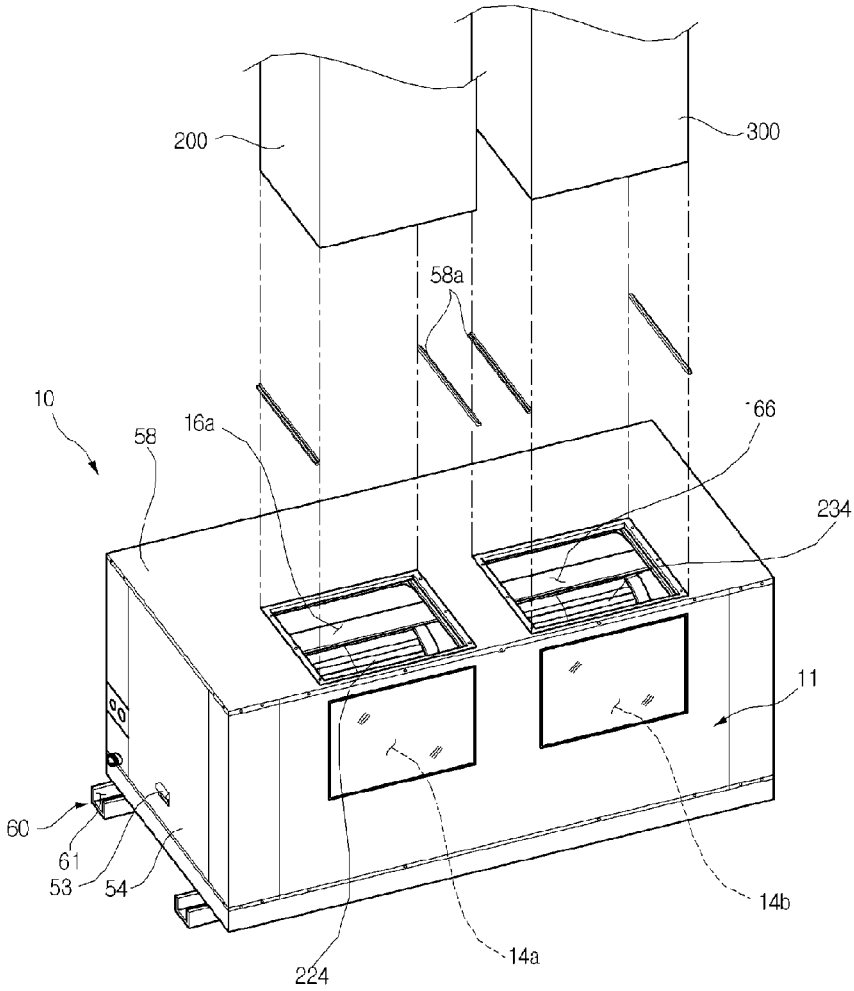
[Fig. 19]
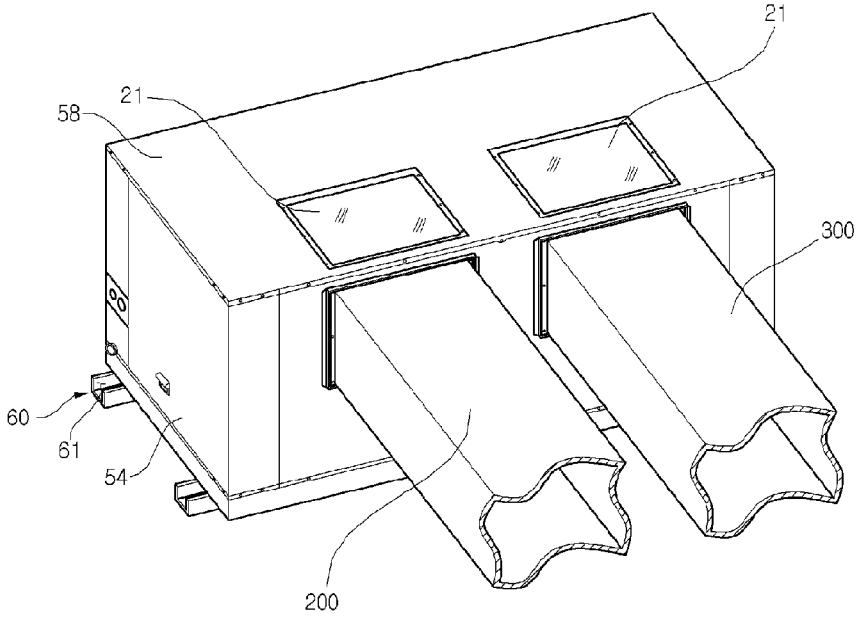

[Fig. 20]
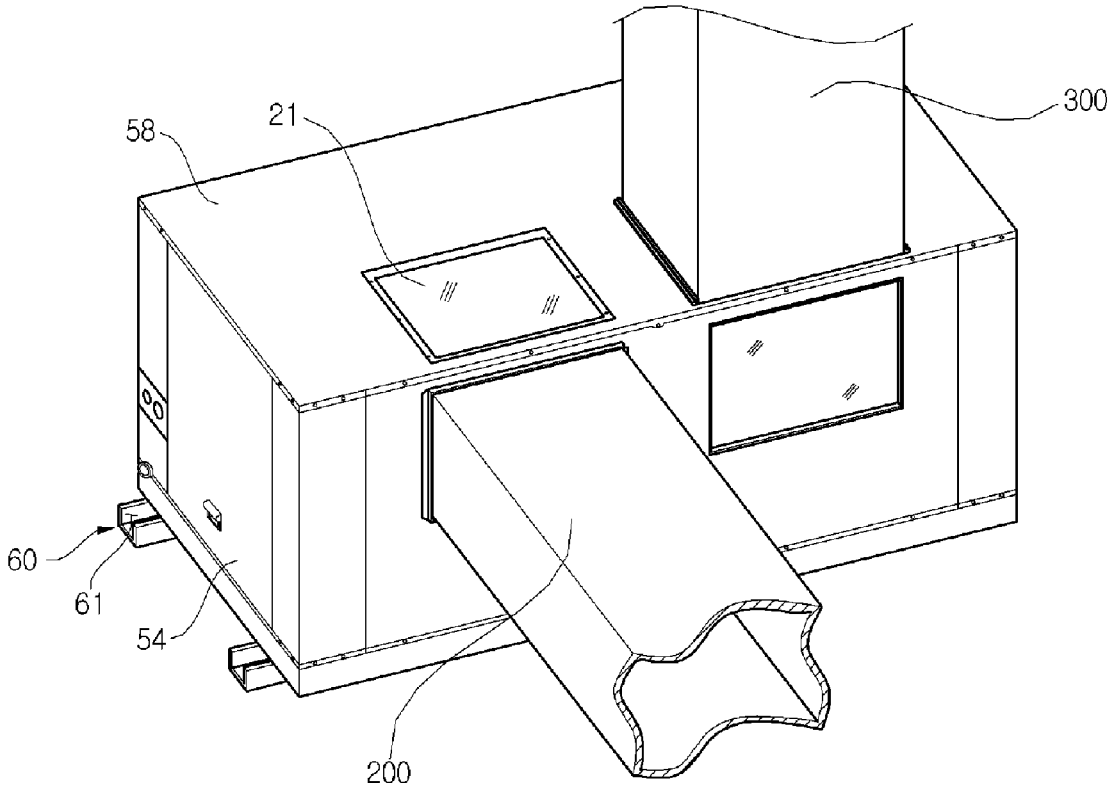

[Fig. 21]
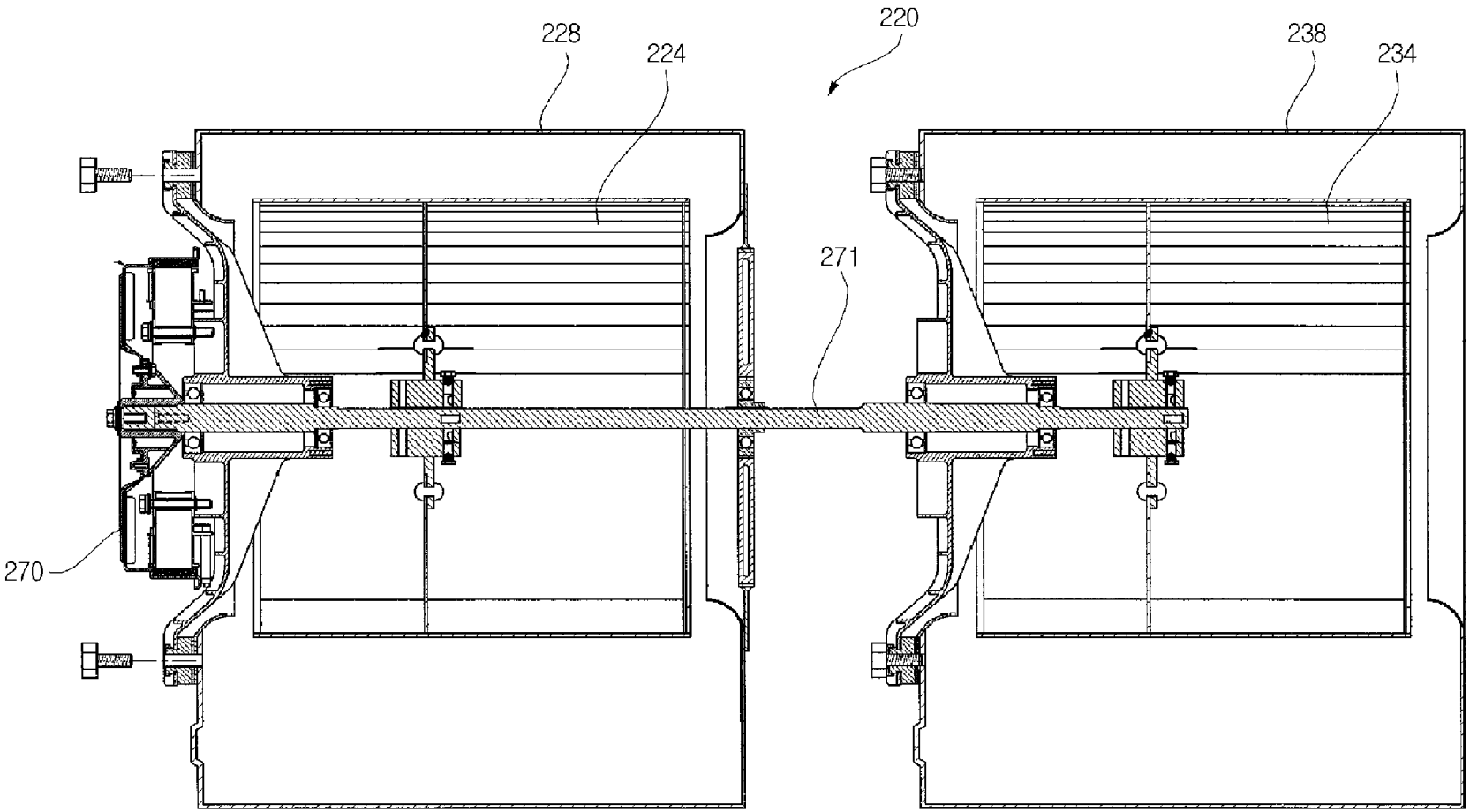

[Fig. 22]
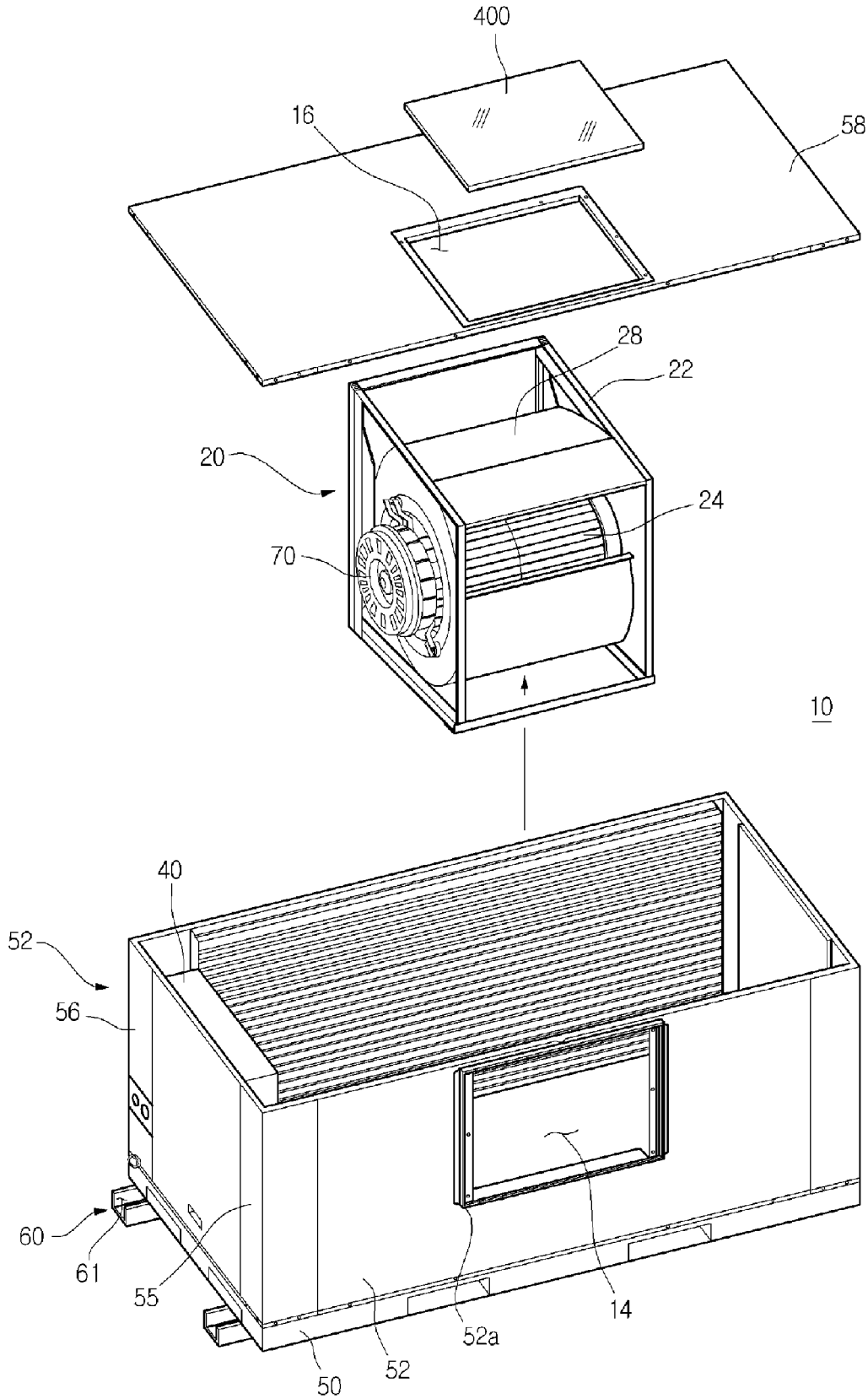

[Fig. 23]
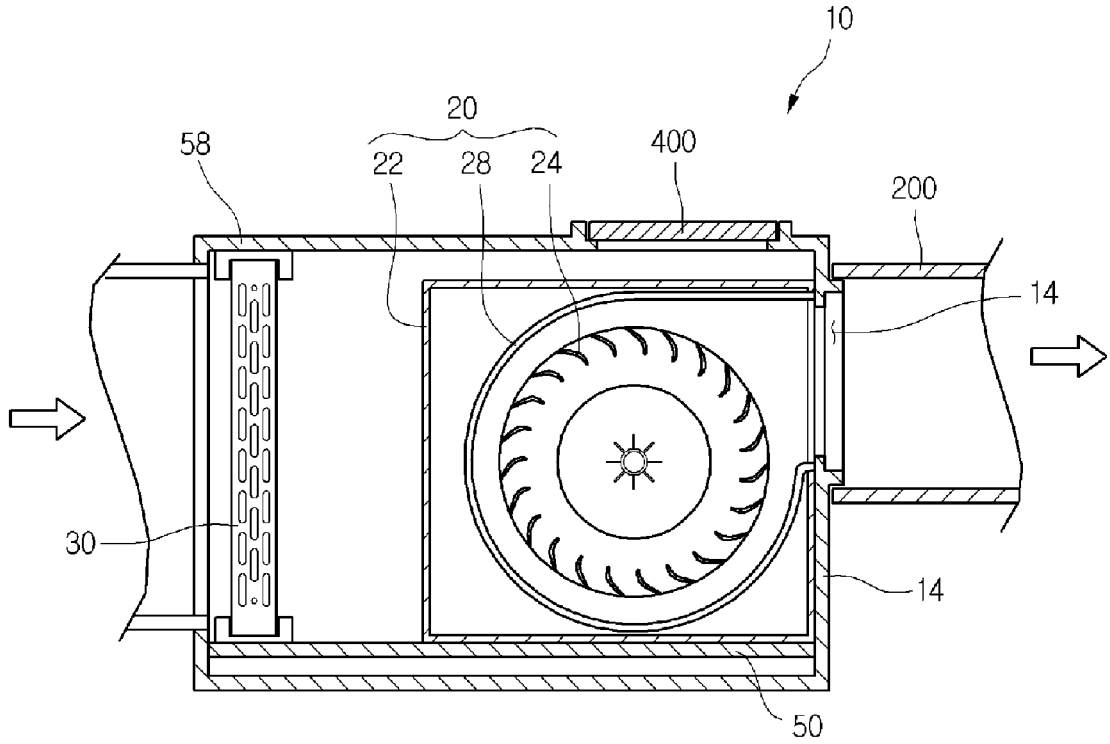
[Fig. 24]
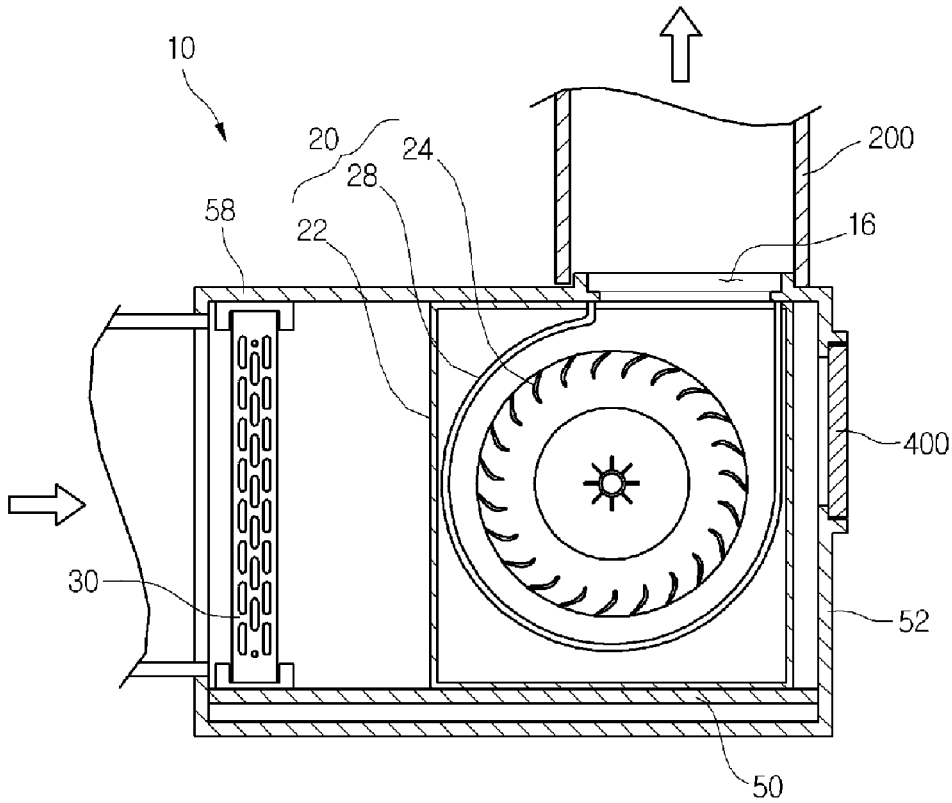

[Fig. 25]
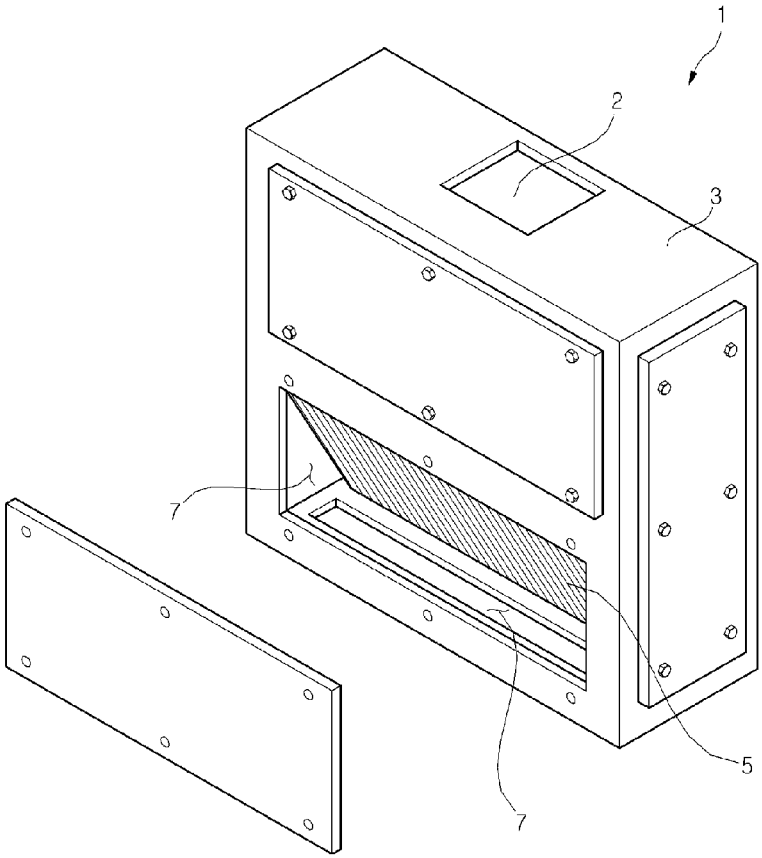
[Fig. 26]
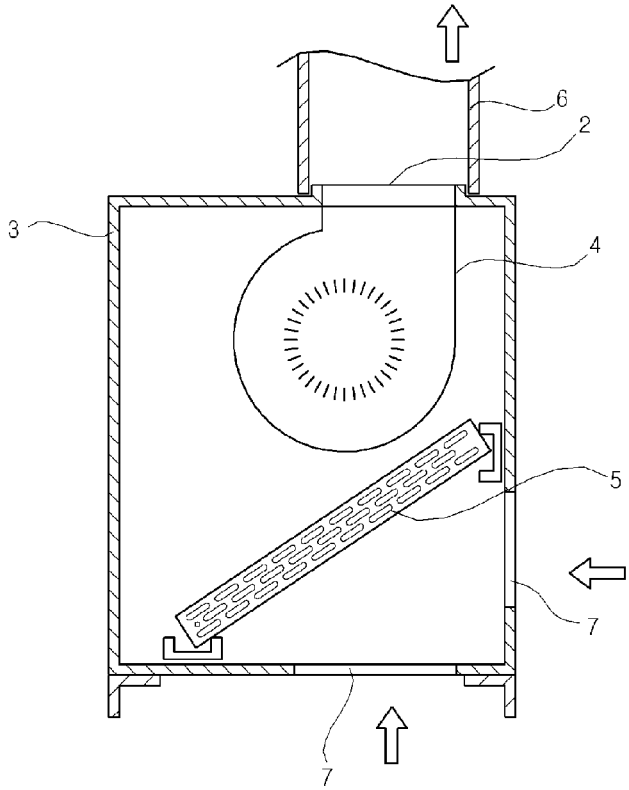

MULTIPLE DISCHARGE PORT INDOOR UNIT OF AIR CONDITIONER

This application claims priority to PCT/KR2006-000255 filed on Jan. 23, 2006, and Korean Application Nos. 10-2005-0007675, 10-2005-0127965, and 10-2005-0131784, filed respectively on Jan. 27, 2005, Dec. 22, 2005 Dec. 28, 2005, in Korea, all of which are hereby incorporated by reference in their entirety.

TECHNICAL FIELD

The present invention relates to an indoor unit of an air conditioner, and more particularly, to an indoor unit of a duct-type air conditioner that allows selection from a plurality of discharge ports formed on a cabinet according to a fixed location of an installed duct, so that installation of the unit is not restricted by the duct's fixed location

BACKGROUND ART

An air conditioner is an apparatus that supplies conditioned air into an interior space. Air conditioners are divided into single unit air conditioners that house all their components in one unit, and split-system air conditioners that consist of an indoor and an outdoor unit.

Due to a scarcity of indoor space that an indoor unit can occupy, a recent trend is the use of duct-type air conditioners that mount the indoor unit on the ceiling, wall surface, veranda, etc., or on the roof or other outdoor space, and supply air that has been heat-exchanged in the indoor unit through a duct into an interior space.

FIG. 25 is a perspective view of an indoor unit of an air conditioner according to the related art, and FIG. 26 is a sectional view of an indoor unit of an air conditioner according to the related art.

Referring to FIGS. 25 and 26, an indoor unit 1 of a duct-type air conditioner according to the related art includes a cabinet 3 in which an intake port 7 and a discharge port 2 are formed, a ventilation fan 4 installed inside the cabinet 3 and connected to the discharge port 2, a heat exchanger 5 installed inside the cabinet for heat exchanging suctioned air, and a duct 6 connected to the discharge port 2.

However, the air conditioner 1 according to the related art suffers from the drawback of having only one discharge port 2 formed in the cabinet 3, where the discharge port 2 is formed toward one side, so that the location for installing the indoor unit 1 is not flexible and the indoor unit 1 is incompatible with ducts located in other varying positions.

DISCLOSURE OF INVENTION

Technical Problem

To solve the above problem, the present invention provides an indoor unit of an air conditioner that allows one of a plurality of discharge ports formed in the cabinet thereof to be selected, according to the installed location of a duct, so that it can be easily installed without being restricted by the installed location or position of the duct.

Another object of the present invention is to provide an indoor unit of an air conditioner that allows a motor to be repaired or replaced by removing a side panel without disassembling the entire cabinet.

A further object of the present invention is to provide an indoor unit of an air conditioner that facilitates the installation of support rails thereon, so that the rails can be mounted below a base thereof to allow it to be transported more easily by a forklift or other vehicle.

A still further object of the present invention is to provide an indoor unit of an air conditioner with a control box with electrical components installed inside its cabinet, to give the unit a clean outward appearance and protect its control box from external forces.

Technical Solution

According to an aspect of the present invention, there is provided an indoor unit of an air conditioner including: a cabinet including a plurality of discharge ports formed on different surfaces thereof; a heat exchanger installed in one side of the cabinet; and at least one ventilation unit installed inside the cabinet and including a discharge port selectively communicating with one of the plurality of discharge ports of the cabinet.

According to another aspect of the present invention, there is provided an indoor unit of an air conditioner including: a base; a cabinet including a front panel installed vertically at a front of the base, a side panel installed vertically at a side of the base, a top panel mounted on a top of the front panel and the side panel, and a corner frame for connecting the side panel and the front panel; at least one ventilation unit mounted to the base for suctioning and discharging indoor air; and a heat exchanger mounted at an inner rear portion of the cabinet.

According to a further aspect of the present invention, there is provided an indoor unit of an air conditioner including: a base; a cabinet coupled to the base and including discharge ports formed at a front and/or a top surface thereof; a heat exchanger installed inside the cabinet; and a ventilation unit coupled to the base for suctioning indoor air, wherein the ventilation unit includes a fan for suctioning indoor air, a motor for driving the fan, a fan housing for guiding a discharging direction of the air suctioned by the fan, and a ventilation fan frame coupled to the base for supporting the fan housing.

According to a still further aspect of the present invention, there is provided an indoor unit of an air conditioner including: a base; a cabinet including a front panel, a side panel, and a top panel that couple vertically from a top of the base; a control box installed on a side of the side panel; a fan assembly fastened to an inside of the cabinet; a motor assembly for driving the fan assembly; and a support rail coupled at a bottom of the base.

Advantageous Effects

An advantage of the indoor unit according to the present invention is that it can connect one from a plurality of discharge ports formed on the cabinet of the indoor unit to a single duct. Thus, the connecting position of a duct to the cabinet can be freely changed, based on the installed location of the indoor unit and the location of a duct to be connected.

Another advantage of the indoor unit according to the present invention is that because a BLDC motor is installed and used in the indoor unit, due to the motor's high reliability and operating efficiency when compared to other types of motors, the air conditioner's indoor unit is enhanced.

A further advantage of the indoor unit according to the present invention is that the installed BLDC motor has its stator housing fixed to the fan housing, so that assembly thereof is simplified and vibration during operation is reduced.

A still further advantage of the indoor unit according to the present invention is that the BLDC motor of the air conditioner indoor unit has a three-armed supporter fixed to the fan housing through a mount, so that air can freely enter through either side of the fan housing.

An additional advantage of the indoor unit according to the present invention is that it may be connected to a plurality of ducts. The discharge ports connected to these ducts are formed on the front panel and the top panel, so that the discharge ports can be easily adapted to fit the installed positions of the ducts. Therefore, each of the plurality of ducts can be connected in mutually different directions to the indoor unit of the air conditioner, so that the discharging directions of the air from the indoor unit can be diversified.

A further additional advantage of the indoor unit according to the present invention is that air can be discharged from only one of the plurality of ducts to vary the capacity of the indoor unit.

An even further additional advantage of the indoor unit of the air conditioner according to the present invention is that it can vary the plurality of ducts in the same or different directions, to lessen the spatial restrictions for installing the indoor unit.

An added advantage of the indoor unit according to the present invention is that because the air conditioner's indoor unit has support rails attached at its bottom, a forklift can be used to easily transport the indoor unit.

A further added advantage of the indoor unit according to the present invention is that when the location of the discharge unit connected to a duct is changed on the indoor unit of the air conditioner, the ventilation unit frame can be rotated and assembled so that discharge ports that are not used can be sealed.

An even further added advantage of the indoor unit according to the present invention is that it allows the cover sealing the discharge ports to be formed integrally with the ventilation unit, so that the surface of the sealing cover can be flush with that of the front panel or top panel. Thus, during transportation of the indoor unit, the coupling region of the sealing cover will not snag on foreign objects and be damaged.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of an indoor unit of a duct-type air conditioner according to the first embodiment of the present invention;

FIG. 2 is an exploded perspective view of an indoor unit of a duct-type air conditioner according to the present invention;

FIG. 3 is a rear perspective view of an indoor unit of a duct-type air conditioner according to the present invention showing the outside of a side panel;

FIG. 4 is a perspective view of a disassembled indoor unit of an air conditioner according to the present invention showing the structure of an electrical component unit;

FIG. 5 is an enlarged perspective view showing the assembling structure of the electrical component unit shown in FIG. 4;

FIG. 6 is a perspective view of a ventilation unit installed on a base panel of a duct-type air conditioner according to the present invention;

FIG. 7 is a side sectional view showing the interior structure of a ventilation unit according to the present invention;

FIG. 8 is a perspective view of a ventilation fan for a ventilation unit according to the present invention;

FIG. 9 is a plan view of the ventilation fan in FIG. 8;

FIG. 10 is a sectional view of a motor mounted to a supporter according to the present invention;

FIG. 11 is a cutaway perspective view of a rotor for a motor according to the present invention;

FIG. 12 is a perspective view of a stator for a motor according to the present invention;

FIG. 13 is an exploded perspective view showing the stator in FIG. 12;

FIG. 14 is a rear perspective view of a supporter according to the present invention;

FIG. 15 is a frontal perspective view of the supporter in FIG. 14;

FIG. 16 is an exploded perspective view showing an assembly and disassembly process of an indoor unit of an air conditioner according to the present invention;

FIG. 17 is a perspective view showing an indoor unit of an air conditioner according to the present invention connected to a duct at the top thereof;

FIG. 18 is a perspective view showing an indoor unit of an air conditioner according to the second embodiment of the present invention connected to two ducts at a top thereof;

FIG. 19 is a perspective view showing the indoor unit in FIG. 18 with a variation of the duct connecting configuration;

FIG. 20 is a perspective view showing the indoor unit in FIG. 18 with another variation of the duct connecting configuration;

FIG. 21 is a sectional view of ventilation units according to the second embodiment of the present invention;

FIG. 22 is an exploded perspective view of an indoor unit of an air conditioner according to the third embodiment of the present invention;

FIG. 23 is a sectional view showing the installed positions of the ventilation unit and the sealing cover according to the connecting location of a duct;

FIG. 24 is a sectional view showing an alternative positioning of the ventilation unit and the sealing cover according to the connecting location of a duct;

FIG. 25 is a perspective view of an indoor unit of an air conditioner according to the related art; and FIG. 26 is a sectional view of an indoor unit of an air conditioner according to the related art.

BEST MODE FOR CARRYING OUT THE INVENTION

Hereinafter, preferred embodiments of an indoor unit of an air conditioner according to the present invention will be described in detail with reference to the accompanying drawings.

FIG. 1 is a perspective view of an indoor unit of a duct-type air conditioner according to the first embodiment of the present invention, and FIG. 2 is an exploded perspective view of an indoor unit of a duct-type air conditioner according to the present invention.

Referring to FIGS. 1 and 2, an indoor unit 10 of an air conditioner according to the present invention includes a cabinet 11 forming the outer shape of the indoor unit 10, a ventilation unit 20 mounted inside the cabinet 11, a heat exchanger 30 mounted in the rear interior of the cabinet 11, and an electrical component unit 40 installed at one end inside the cabinet 11.

In further detail, the cabinet 11 includes a base panel 50 for mounting the ventilation unit 20 on top of, a front panel 52 installed to rise perpendicularly from the front of the base panel 50, a side panel 54 installed to rise perpendicularly from the side of the base panel 50, a top panel 58 mounted on top of the front panel 52 and side panel 54, a front corner frame 55 installed on the front corner of the base panel 50, and rear corner frame 56 installed at the rear corner of the base panel 50.

Additionally, a front discharge port 14 of a predetermined size is formed on the front panel 52, and a top discharge port 16 of a predetermined size is formed on the top panel 58. Brackets 52*a* and 58*a* are installed on the edges of the front discharge port 14 and the top discharge port 16, so that a duct can be firmly installed on the front panel 52 or the top panel 58. An intake port 12 is formed on the rear of the cabinet 11, and a heat exchanger 30 is installed at the front of the intake port 12. Thus, air that enters through the intake port 12 passes through the heat exchanger 30 to become cooler or hotter. Here, the intake port 12 is sealed completely by the heat exchanger 30 so that air must pass through the heat exchanger 30 in order to flow into the intake port 12. The front and side panels 52 and 54 are supported by the front and rear corner frames 55 and 56.

In further detail, the lower ends of the corner frames 55 and 56 are connected to the base panel 50, and the upper ends thereof are connected to the top panel 58, so that the cabinet 11 does not move and is firmly held.

A bracket 32 is provided at the edge of the heat exchanger 30 to connect to the rear corner frame 56. The rear corner frame 56 also has a bracket 34 attached for connecting to an intake duct (not shown). A support valve mechanism 35 for connecting to the heat exchanger 30 is installed on one of the two rear corner frames 56. A refrigerant pipe (not shown) that connects to an outdoor unit connects to the support valve mechanism 35 which is connected to the heat exchanger 30.

A support rail 60 for supporting the base panel 50 is installed at the bottom of the base panel 50. Specifically, the support rail 60 has a grooved portion 61 bent in a "u"-shape and an upper portion that is fastened to the bottom of the base panel 50. The support rail 60 is fastened at opposite ends at the bottom of the base panel 50, to be evenly separated and aligned from front to back or from left to right on the base panel 50.

By installing the above support rail 60 on the bottom of the base panel 50, when the indoor unit 10 is moved, the forks (not shown) of a forklift can be inserted into the grooved portion 61 of the support rail. Thus, even when the forklift itself wobbles during transporting, there is no danger of the indoor unit 10 slipping off the forks of the forklift and falling. Moreover, because the support rail 60 is fastened to the base panel 50 by means of bolts or screws (not shown), its installation is simple.

In order to ensure that the above effects are obtained, the support rails 60 are spaced a predetermined distance apart from one another to accommodate the insertion of a standard forklift's forks, and the grooved portions 61 are formed to have an adequate width so that a forklift's forks can be inserted therein.

FIG. 3 is a rear perspective view of an indoor unit of a duct-type air conditioner according to the present invention showing the outside of a side panel.

Referring to FIG. 3, an electrical component unit 40 according to the present invention is installed inside the cabinet 11, and is sealed by the side panel 54 from exposure to the outside.

Specifically, the front and rear ends of the side panel 54 are fastened to the front and rear corner frames 55 and 56, respectively. A handle 53 is formed on the outer surface of the side panel 54. Thus, when disassembling and assembling the side panel 54, a user can grasp the handle 53.

The handle 53 is inserted into and fixed in a hole formed on the side panel 54 or is fastened to the outer surface of the side panel 54 by means of a fastening member. In further detail, if the handle is inserted and fixed to the side panel 54, the handle includes an inserting portion 53*a* that inserts into a hole formed in the side panel 54, a fastening portion 53*b* that fastens to the outer surface of the side panel 53, and a grasping hole 53*c* formed for a user to insert his/her hand into for grasping.

For applications in which the side panel must be opened for regular servicing, the side panel 54 may be hinge-coupled by an edge thereof to a corner frame 55 or 56 or the top panel 58, so that it swings open in an upward/downward direction or a left-right direction.

FIG. 4 is a perspective view of a disassembled indoor unit of an air conditioner according to the present invention showing the structure of an electrical component unit, and FIG. 5 is an enlarged perspective view showing the assembling structure of the electrical component unit shown in FIG. 4.

Referring to FIGS. 4 and 5, both ends of the electrical component unit 40 are inserted to the corner frames 55 and 56, and then fastened thereto by means of bolts or screws.

Specifically, the electrical component unit 40 includes a control box 42 coupled to the corner frames 55 and 56, a main PCB 45 installed inside the control box 42, a motor driver (not shown) for supplying a current to the ventilation unit 20, and an intelligent power module (IPM) (not shown) for supplying a direct current to the motor driver (not shown).

In further detail, the IPM is an insulated gate bipolar transistor (IGBT) combined with a dedicated driver in a single package, that was recently developed and is being used in a variety of applications for power management in the field of high capacity motor control. The IPM includes a driver IC, a high current protection circuit, a short circuit protecting circuit, and many other protective circuits within, and reduces the size of the motor driver and has the benefits of lower power consumption and a small size.

The control box 42 is formed in a cuboid shape, with the main PCB 45 installed within, and the front thereof opened and closed by the side panel 54. That is, when the side panel 54 is disassembled, the inside of the electrical component unit 40 is exposed, facilitating servicing. The control box 42 is sealed by the side panel 54 to prevent the electrical components from being exposed to the outside.

Both ends of the control box 42 each have a flange 44 formed to extend therefrom to couple to the corner frames 55 and 56.

The interior end of the corner frame 55 and 56 includes a flange 57 that extends and presses against the front portion of the flange 44 of the control box 42, and the upper portion of the flange 57 has a latch notch 57*a* notched a predetermined depth. Also, the flange 44 of the control box 42 has a latch 47 that extends from the front thereof to latch onto the flange 57 of the corner frame 55. The lower portion of the latch 47 has a latch notch 47*a* notched a predetermined depth upwards.

In more detail, the latch notch 47*a* formed in the latch 47 and the latch notch 57*a* formed in the upper portion of the corner frame 55 and 56 couple together, to fasten the control box 42 to the corner frame 55 and 56. The flange 57 of the corner frame 55 and 56 and the latch 47 of the control box 42 are formed in respectively intersecting directions, so that the latch 47 and the flange 57 fasten by crossing each other. Thus, an assembler presses the control box 42 against the rear surface of the flange 57, and lowers the control box 42 so that the latch 47 and the flange 57 firmly couple to each other. Assembly is therefore very simple to perform.

If additional fastening is required, the assembler may use a fastening member to fasten the control box 42 to the corner frame 55.

FIG. 6 is a perspective view of a ventilation unit installed on a base panel of a duct-type air conditioner according to the present invention.

Referring to FIG. 6, the ventilation unit 20 according to the present invention includes a ventilation fan frame 22 fixed to the cabinet 11, a ventilation fan 24 for suctioning indoor air into the cabinet 11, a motor 70 for driving the ventilation fan 24, a fan housing 28 for guiding the air ventilated by the ventilation fan 24 to a discharge port 14, and a supporter 90 for fastening the motor 70 to the side of the fan housing 28.

In further detail, the ventilation fan 24 may be a sirocco fan that suctions air from both sides of the fan housing 28 and discharges the air through the front discharge port of the fan housing 28.

Additionally, a ventilation fan frame 22, for fastening the fan housing 28 to the base panel 50, is skeletally cuboid in shape and has the fan housing 28 fastened inside.

Here, an upper sealing cover 21 for sealing the upper discharge port 16 formed on the top panel 58 is installed at the top of the ventilation frame 22. Also, a lower sealing cover 23 for sealing the front discharge port 14 formed on the front panel 52 is installed on the lower portion of the ventilation frame 22. When the ventilation unit 20 is installed on the base panel 50 so that the front discharge port 14 is opened, the upper discharge port 16 formed on the top panel 58 is sealed by the upper sealing cover 21 installed on top of the ventilation fan frame 22. Conversely, when the ventilation unit 20 is installed on the base panel 50 so that the upper discharge port is opened, the front discharge port 14 formed on the front panel 52 is sealed by the lower sealing cover 23 installed at the bottom of the ventilation fan frame 22.

Additionally, when the top panel 58 is positioned on top of the ventilation unit 20, the upper or front sealing cover 21 or 23 is formed on the same respective plane as the outer surface of the top panel 58 or the front panel 52. In other words, the sealing covers 21 and 23 do not protrude from the top panel 58 or the front panel 52, and are flush therewith.

The sealing covers 21 and 23 are assembled in a single piece with the ventilation frame 22 that is installed on the base panel 50. Accordingly, the process of closing the discharge port 14 or 16 includes installing the front panel 52 or top panel 58, and installing the ventilation unit 20.

Likewise, when the sealing covers 21 and 23 are coupled in one piece with the ventilation unit 20, in order to close one of the discharge ports 14 and 16, there is no need to install a separate cover.

Below, each of the components in the ventilation unit will be described in further detail with reference to the diagrams.

FIG. 7 is a side sectional view showing the interior structure of a ventilation unit according to the present invention, FIG. 8 is a perspective view of a ventilation fan for a ventilation unit according to the present invention, and FIG. 9 is a plan view of the ventilation fan in FIG. 8.

Referring to FIGS. 7 through 9, the ventilation unit 20 according to the present invention is fixed to a ventilation fan frame 22.

A ventilation unit 20 according to the present invention includes a ventilation frame 22, a fan housing 28 fastened to the ventilation frame 22, a ventilation fan 24 installed inside the fan housing 28 for suctioning air, a motor 70 for rotating the ventilation fan 24, and a supporter 90 for fastening the motor 70 to a side of the fan housing 28.

In further detail, the motor 70 that drives the ventilation fan 24 may be a brushless DC (BLDC) motor. The fan housing 28 is fixed to the ventilation fan frame 22, and has intake openings 28*a* and 28*b* formed respectively at the left and right thereof. The motor 70 is installed at one of the intake openings 28*a* and 28*b*. Here, the intake openings 28*a* and 28*b* each have a shroud curved at a predetermined curvature inward.

The motor 70 includes a shaft 71 connected to the ventilation fan 24, a rotor 72 connected to the end of the shaft 71, and a stator 80 installed to be spaced at a pre-determined gap inward from the inner surface of the rotor 72. The stator 80 is fixedly installed on the supporter 90. The shaft 71 passes through the center of the ventilation fan 24 and rotates integrally with the ventilation fan 24.

Also, the ventilation fan 24 is formed with a blade 24*a* and a plate 24*b* that connects and fixes the blade 24*a*.

Specifically, a bushing 27 is shaft-connected to the outer surface of the shaft 71, and the ventilation fan 24 is coupled to the shaft 71 through the bushing 27.

More specifically, the bushing 27 includes a cylindrical portion 27*a* (through which the shaft 71 passes) and a flange portion 27*b* that projects outward from the cylindrical portion 27*a* in a radial direction and to which the plate 24*b* is firmly coupled. Also, the flange portion 27*b* of the bushing 27 has rivets 27*c* installed thereon for coupling the plate 24*b* to the flange 27*b* of the bushing 27. The cylindrical portion 27*a* of the bushing 27 has bolts 27*d* inserted through it in order to fasten the bushing to the shaft 71.

A detailed description of the structure of the motor and supporter will be given below with reference to the diagrams.

FIG. 10 is a sectional view of a motor mounted to a supporter according to the present invention, FIG. 11 is a cutaway perspective view of a rotor for a motor according to the present invention, FIG. 12 is a perspective view of a stator for a motor according to the present invention, and FIG. 13 is an exploded perspective view showing the stator in FIG. 12.

Referring to FIGS. 10 through 13, a motor 70 according to the present invention includes a rotating rotor 72 connected to a shaft 71, and a stator 80 installed inward to the rotor 72 and fixed to a supporter 90.

Specifically, the rotor 72 includes a rotor bushing 73 coupled to the shaft 71, a rotor housing 75 coupled to the rotor bushing 73 and installed to cover the stator 80, and a magnet 76 installed on the rotor housing 75 and spaced a predetermined gap from the stator 80.

In further detail, serrations (not shown) are formed on the inner surface of the rotor bushing 73 and the outer surface of the shaft 71, so that the respective serrations mesh. The shaft 71 and the rotor bushing 73 are fastened together by a bolt 71*a* or other fastening member. Here, the rotor bushing 73 may be formed of a non-conductive material.

Also, the rotor bushing 73 and the rotor housing 75 are fastened together with bolts 73*a*. Although not shown, the rotor bushing may be coupled to the outside of the rotor housing.

The magnet 76 is fixed to the inner surface of the cylindrically-shaped rotor housing 75, to rotate and interact with the stator. Here, the magnet 76 is seated against a ledge 75*f* formed in the inner wall of the rotor housing 75, and is formed cylindrically along the inner wall of the rotor housing 75.

The rotor housing 75 includes a floor surface 75 in a rough disk shape, and a side wall 75*b* extending perpendicularly from the edge of the floor surface 75*a*. The side wall 75*b* is stepped at least once by the ledge 75*f*. In the case where the rotor housing 75 is a steel plate, the floor surface 75*a* and the side wall 75*b* are formed in one piece through press-forming.

Here, the end of the side wall 75*b* has a bent portion 75*c* bent to flare outwards and provide stiffness to the side wall 75*b* to prevent disfiguration of the rotor 72 when rotating at high speed and noise caused by such disfiguration.

The inner portion of the floor surface 75*a* of the rotor housing 75 includes a protruding hub 75*d* for installing the rotor bushing 73, and a cooling fin 75*e* for directing air from outside the motor housing 75 into the motor housing 75. Specifically, the cooling fin 75*e* is formed using a lancing process to bend inward into the rotor housing 75. The cooling fin 75*e* is formed in plurality, and is disposed radially around the shaft. The magnet 76 is also installed in plurality along the inner side wall 76*b* of the rotor housing 75.

The hub 75*d* has a plurality of holes formed therein, through which fastening members pass to couple to the rotor bushing 73.

The stator 80 includes a core plate 82 forming teeth 82*a*, a coil 84 of wire wound on the coil plate 82, and an insulator 86 surrounding the coil plate 82.

In more detail, the coil plate 82 is formed in a single band with its steel parts wound spirally with wire, so that its overall form is that of a ring.

In still further detail, the teeth 82*a* are disposed radially around the coil plate 82 when the latter is formed in a ring. A plurality of coil plates 82 are stacked on top of one another. Also, the coil 84 is wrapped a plurality of times around the multi-layered teeth 82*a*.

The insulator 86 includes an upper insulator 86*a* that couples to the upper end of the coil plate 82, and a lower insulator 86*b* that wraps around and couples to the lower end of the coil plate 82. The insulator 86, unlike that in the current embodiment, may be formed in one piece, in which case the coil plate is inserted into resin during manufacturing.

The insulator 86 is formed to project more in a vertical direction than the thickness of the coil 84. In other words, the ribs 86*c* covering the teeth 82*a* of the coil plate 82 protrude in upward and downward directions beyond the thickness of the coil 84 wrapped around the teeth 82*a*.

The upper insulator 86*a* and the lower insulator 86*b* respectively have a coupling portion 87 protruding inward from the inner portions thereof. The coupling portions 87 of the upper insulator 86*a* face those of the lower insulator 86*b*. In further detail, at least three coupling portions 87 are formed to protrude inward from the core plate 82. The coupling portion 87 has a coupling hole 87*a* of a predetermined diameter formed within. A metal tube 87*b* is force-fitted through coupling portions 87 of the upper and lower insulators 86*a* and 86*b*, so that the metal tube 87*b* fixes the upper and lower insulators 86*a* and 86*b* around the outer surface of the core plate 82.

Here, the vertical length (or thickness) of the coupling portion 87 is 20% or greater than the thickness of the stacked core plate 82. This is because the coupling portion 87 must be formed to be at least 20% thicker than the stacked core plate 82 in order to sufficiently withstand vibration generated during operation of the motor.

The stator 80 is coupled to the supporter 90, to be proximal to the intake opening 28*a* of the fan housing 28. The motor 70 is cooled by air that flows through the fan housing 28.

FIG. 14 is a rear perspective view of a supporter according to the present invention, and FIG. 15 is a frontal perspective view of the supporter in FIG. 14.

Referring to FIGS. 14 and 15, the supporter 90 according to the present invention includes a bearing housing 92 that extends a predetermined distance forward from the supporter 90, and which supports the shaft 71 that inserts through the bearing housing 92.

In more detail, the supporter 90 has a bearing housing 92 with bearings 91 installed within that support the shaft 71, fixture arms 94 extending radially from the lower outer surface of the bearing housing 92 to attach and fix to the fan housing 28, and a stator mounting portion 96 formed below the fixture arm 94 for attaching and fixing the stator 80.

Additionally, a long hole 92*a* is formed through the bearing housing 92 for the shaft 71 to pass therethrough, and a plurality of bearings 91 for supporting the outer surface of the shaft 71 are installed inside the long hole 92*a*.

The stator mounting portion 96 fastens to the stator 80 by means of bolts, etc., and is formed in a discoid plate shape with a predetermined diameter at the bottom of and integrally with the bearing housing 92.

Here, the stator mounting portion 96 not only has holes 96*a* for inserting fastening members therethrough to fasten the stator 80, but also has wide through-holes 96*b* formed for dispersing heat created by the stator 80 to the outside.

The fixture arm 94 is formed in triplicate as a tripod, extends radially from the outer surface of the bearing housing 92, and has a hole 94*a* of a predetermined size formed at its end. A bolt 95 inserts through the hole 94*a*, so that the supporter 90 couples to the side of the fan housing 28.

In further detail, a mounting member 97 is interposed between the end of the fixture arm 94 and the fan housing 28. The mounting member 97 absorbs vibrations from the motor 70 and the ventilation fan 24. Accordingly, the mounting member 97 may be formed of an elastic material. The supporter 90 may be cast from aluminum.

A reinforcing rib 98 is further formed to connect the top surface of the fixture arm 94 to the outer surface of the bearing housing 98 of the supporter 90. The reinforcing rib 98 prevents warping or breaking of the fixture arm 94 to increase the structural strength of the supporter 90.

FIG. 16 is an exploded perspective view showing an assembly and disassembly process of an indoor unit of an air conditioner according to the present invention.

Referring to FIG. 16, a detailed description of the assembly and disassembly of the air conditioner indoor unit 10 according to the present invention will be given.

First, in order to assemble the indoor unit, an assembler fastens the support rails 60 to the bottom of the base panel 50, and fastens the ventilation frame 22 (to which the ventilation unit 20 is fixed) to the top surface of the base panel 50.

Here, the installation position of the ventilation fan 22 is adjusted so that the discharge port of the fan housing 28 matches one of the front discharge port 14 of the front panel 52 or the top discharge port 16 of the top panel 58. In more detail, when the discharge port of the ventilation frame 22 communicates with the front discharge port 14, the upper sealing cover 21 closes the top discharge port 16.

The assembler then couples the corner frames 55 and 56 respectively at the four corners of the base panel 50, and couples the electronic component unit 40 on one end.

To explain the installation process of the electronic component unit 40 once again, the control box 42 of the electronic component unit 40 is moved downward so that latches 47 formed on either side of the control box 42 latch onto the latch notches 57*a* of the flanges 57 formed on the corner frames 55. The latch 47 of the control box 42 latches and fixes to the flange 57 of the corner frame 55, and latch and the flange 57 are coupled by means of a fastening member.

Next, the assembler connects the electrical wires installed in the control box 42 to the motor 70 of the ventilation unit 20, so that the motor 70 can be controlled by the electrical component unit 40. Next, the side panel 54 is coupled between the front corner frame 55 and the rear corner frame 56 to seal the electrical component unit 40.

Then, the assembler installs the heat exchanger 30 at the rear of the cabinet 11. The remaining side panel 54 and the front panel 52 are respectively coupled to the corner frames 55 and 56. After the side panel 54 and the front panel 52 are assembled, the assembler mounts the top panel 58 on the cabinet 11 to complete the assembly.

Here, the upper sealing cover 21 that closes the discharge port 16 of the top panel 58 is coupled integrally with the ventilation fan frame 22, so that the assembler need only to assemble the top panel 58 to complete assembly of the cabinet 11.

The top surface of the top panel 58 is formed to have a flush, flat surface, and a separate bracket 58*a* for connecting a duct is attached thereto if the duct (not shown) is to be connected to the discharge port 16.

FIG. 17 is a perspective view showing an indoor unit of an air conditioner according to the present invention connected to a duct at the top thereof.

Referring to FIG. 17, a description of the assembling process of the indoor unit 10 and duct according to the present invention will be given.

Before describing FIG. 17, a description of a duct 200 installed at the front of an indoor unit 10 will first be given.

As shown in FIG. 1, when a duct 200 is to be disposed at the front of an indoor unit 10, an installer installs a bracket 52*a* at the edge of the front discharge port 14, and then connects the duct 200 to the front panel 52 by means of the bracket 52*a*.

However, as shown in FIG. 17, when the location of the duct 200 and that of the open discharge port of the cabinet 11 do not coincide, an installer disassembles the cabinet 11 to change the location of the discharge port and the installed position of the ventilation unit 20.

For this end, the installer first removes the top panel 58 to open up the cabinet 11, and then disassembles the base panel 50 and the ventilation frame 22. The installer then rotates the disassembled ventilation frame 22 towards the top, so that the discharge port of the fan housing 28 moves toward the top. Then, the ventilation frame 22 is fastened to the base panel 50.

Here, the lower sealing cover 23 that was attached at the bottom of the ventilation frame 22 rotates to be exposed at the front of the cabinet 11 through the rotation of the ventilation frame 22, so that the front discharge port 14 of the front panel 52 is closed. Then, the installer fixes the ventilation unit 20 to the base panel 50, and reassembles the top panel 58 so that the discharge port of the fan housing 28 aligns with the top discharge port 16 of the top panel 58.

Finally, the installer installs the bracket 58*a* of the top panel 58 and connects the top panel 58 to the duct 200.

Below, the disassembling process of the motor will be explained.

When a malfunction of the indoor unit occurs, and a repair person needs to disassemble the motor 70 installed inside the cabinet 11, the repair person removes the side panel 54 of the cabinet 11 from the corner frame 55.

In further detail, the repair person unscrews the bolts in the side panel 54, and removes the side panel 54 from the corner frames 55 and 56. Here, the repair person grasps the handle 53 installed in the side panel 54 and pulls, to prevent the side panel from falling. Next, the repair person removes the electrical component unit 40 from the corner frame 55.

When the control box 42 of the electronic component unit 40 is disassembled, the motor 70 installed in the ventilation unit 20 is accessible to the repair person, who can remove the exposed motor 70 from the panel housing 28.

In further detail, the repair person removes the bolt 95 of the supporter 90 connecting the fan housing 28 and the motor 70, and removes the motor 70 from the fan housing 28.

If the repair person seeks to disassemble only the rotor 72 of the motor 70, (s)he can accomplish this task by removing the bolt 71*a* coupling the rotor bushing 73 and the shaft 71, so that only the rotor 72 portion can be easily removed from the motor 70.

Also, when the rotor 72 is disassembled, the stator 80 portion is also exposed to the repair person, so that (s)he can easily check for defective parts.

In other words, the indoor unit 10 according to the present invention allows not only the disassembly of the motor 70 without having to disassemble the ventilation unit 20, but also allows removal of the rotor 72 without first removing the motor 70, in order to inspect the inside of the motor 70.

FIG. 18 is a perspective view showing an indoor unit of an air conditioner according to the second embodiment of the present invention connected to two ducts at a top thereof, FIG. 19 is a perspective view showing the indoor unit in FIG. 18 with a variation of the duct connecting configuration, and FIG. 20 is a perspective view showing the indoor unit in FIG. 18 with another variation of the duct connecting configuration.

FIG. 21 is a sectional view of ventilation units according to the second embodiment of the present invention.

Referring to FIGS. 19 through 20, the second embodiment according to the present invention differs from the first embodiment thereof in that a plurality of ducts 200 and 300 are installed on the cabinet 11.

Specifically, the indoor unit 10 according to the present invention includes a plurality of sets of discharge ports for connecting the plurality of ducts 200 and 300, and a ventilation unit 220 for ventilating air through the plurality of ducts 200 and 300.

In further detail, the sets of discharge ports include a first discharge port set (with a front discharge port 14*a* and a top discharge port 16*a*) and second discharge port set (with a front discharge port 14*b* and a top discharge port 16*b*). More sets of discharge ports may be formed, depending on the number of ducts. In order to discharge air to each set of discharge ports, the ventilating unit 220 a number of ventilation fans are installed corresponding to the number of ducts. Aside from the above differences in structure, the remaining components are the same as those in the first embodiment, and an explanation thereof will thus be omitted herein.

The plurality of ducts include the first and second ducts 200 and 300, which can be installed in the same direction (as shown in FIG. 19), or in mutually different directions (as shown in FIG. 20).

Although not shown, the cabinet 11 may be capable of being connected to a plurality of ducts 200 and 300, but may be connected to only one duct.

Specifically, the indoor unit 10 of an air conditioner according to the second embodiment of the present invention may be installed in an area with variable quantities of cooling or heating, and may increase or decrease the amount of air that is ventilated by the ventilation fans through the ducts 200 and 300.

For example, to cool or heat a small indoor space according to an initial setting, only one of the first and second sets of discharge ports (14*a* and 16*a*) and (14*b* and 16*b*) may be connected to a duct, and the other set of discharge ports not connected to a duct is sealed by a closing member. If the indoor space to be cooled or heated increases, there is no need to install an additional air conditioner. The closing member that sealed the set of discharge ducts can be removed so that another duct can be utilized, for an increased cooling or heating capacity can be obtained.

Because the connecting direction of the ducts to the cabinet 11 according to the second embodiment can be interchanged between a front and top connecting direction when space in addition to that of the initial setting is added for cooling or heating, the indoor unit can more easily fulfill the additional requirements.

There is no problem posed by providing a dedicated ventilation fan to ventilate air to each duct 200 and 300 of the cabinet 11.

However, while two fans 224 and 234 are installed to respectively ventilate air for the two ducts 200 and 300 in this embodiment, the two fans 224 and 234 are driven by the same motor 270.

In further detail, the motor 270 has a shaft 271 installed that passes through the center of the fans 224 and 234, and the shaft 271 also passes through one fan housing 228 in which the motor 270 is installed and is connected to a fan 234 inside the next fan housing 238.

Although both fans 224 and 234 in this embodiment are connected to the same motor 270, the fans 224 and 234 are housed in separately installed fan housings 228 and 238.

Accordingly, one of the fan housings 228 and 238 may be rotated, according to the connecting direction of the ducts 200 and 300, so that the location of the discharge port of the fan housing can be varied.

The assembly of the shaft 271 and the fans 224 and 234 and other structural aspects are the same as in the first embodiment, and are thus omitted herein.

MODE FOR THE INVENTION

FIG. 22 is an exploded perspective view of an indoor unit of an air conditioner according to the third embodiment of the present invention.

Referring to FIG. 22, the indoor unit 10 of an air conditioner according to the third embodiment of the present invention includes a separate sealing cover 400 that is used for sealing a discharge port formed on the front or top panel of the cabinet.

With the exception of the sealing cover 400, the indoor unit 10 according to third embodiment of the present invention has the same structure as that of the first embodiment. Thus, description of the same components will be omitted.

In further detail, the indoor unit 10 has a discharge port (other than the discharge port of the cabinet 11 that communicates with a discharge port of the fan housing 28) that is sealed by the sealing cover 400.

FIG. 23 is a sectional view showing the installed positions of the ventilation unit and the sealing cover according to the connecting location of a duct, and FIG. 24 is a sectional view showing an alternative positioning of the ventilation unit and the sealing cover according to the connecting location of a duct.

FIG. 23 shows a case where the duct 100 is connected at the front of the indoor unit 10. Here, the discharge port of the fan housing 28 is communicated with the front discharge port 14, and the sealing cover 400 is coupled to the top discharge port 16 on the top panel 58.

FIG. 24 shows a case where the duct 100 is connected at the top of the indoor unit 10. Here, the ventilation unit 20 is rotated upward so that the discharge port of the fan housing 28 is communicated with the top discharge port 16, and the sealing cover 400 is coupled to the front discharge port 14 on the front panel 52.

The indoor unit according to the present invention can connect one from a plurality of discharge ports formed on the cabinet of the indoor unit to a single duct. Thus, the connecting position of a duct to the cabinet can be freely changed, based on the installed location of the indoor unit and the location of a duct to be connected.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

One from a plurality of discharge ports formed on the cabinet of the indoor unit can be connected to a single duct. Thus, the connecting position of a duct to the cabinet can be freely changed, based on the installed location of the indoor unit and the location of a duct to be connected, for a high industrial applicability.

The invention claimed is:

1. An indoor unit of an air conditioner comprising:

a base;

a cabinet coupled to the base and including a first discharge port formed in a first surface of the cabinet and a second discharge port formed in a second surface of the cabinet;

a heat exchanger installed inside the cabinet; and a ventilation unit installed inside the cabinet for suctioning indoor air, wherein the ventilation unit includes:

a fan for suctioning indoor air;

a motor for driving the fan;

a fan housing guiding a discharging direction of the air suctioned by the fan and having a fan discharge port that is fitted with the first discharge port of the cabinet when the ventilation unit is installed inside the cabinet in a first installation position and is fitted with the second discharge port of the cabinet when the ventilation unit is installed inside the cabinet in a second installation position;

a ventilation fan frame for supporting the fan housing;

a first sealing member coupled to the ventilation fan frame, wherein the first sealing member coupled to the ventilation fan frame seals the first discharge port of the cabinet when the ventilation unit is installed inside the cabinet in the second installation position and the first sealing member coupled to the ventilation fan frame does not seal the first discharge port of the cabinet when the ventilation unit is installed inside the cabinet in the first installation position; and a second sealing member coupled to the ventilation fan frame, wherein the second sealing member coupled to the ventilation fan frame seals the second discharge port of the cabinet when the ventilation unit is installed inside the cabinet in the first installation position and the second sealing member coupled to the ventilation fan frame does not seal the second discharge port of the cabinet when the ventilation unit is installed inside the cabinet in the second installation position, wherein the first sealing member and the second sealing member are coupled to the ventilation fan frame at the same time.

2. The indoor unit according to claim 1, wherein the heat exchanger is installed on an edge at one side of the cabinet with an air intake port formed immediately behind the heat exchanger.

3. The indoor unit according to claim 1, wherein the one of the first discharge port and the second discharge port is connected to a duct.

4. The indoor unit according to claim 1, wherein the first and second sealing members are coupled to the cabinet.

5. The indoor unit according to claim 1, wherein the first and second sealing members are integrally coupled to the ventilation unit.

6. The indoor unit according to claim 1, wherein the first discharge port and the second discharge port are formed on a front and a top surface of the cabinet.

7. The indoor unit according to claim 1, wherein the motor assembly has:

a supporter fixed to the fan housing;

a stator fixed to the supporter;

a rotating rotor surrounding an outer surface of the stator; and a shaft passing through a center of the stator and connected to the rotor.

8. The indoor unit according to claim 1, further comprising an electronic component unit installed inside the cabinet.

9. The indoor unit according to claim 1, wherein the cabinet further includes:

a corner frame installed vertically at a corner of the base;

a front panel installed vertically at a front of the base;

a side panel installed vertically at a side of the base; and a top panel mounted on a top of the corner frame.

10. The indoor unit according to claim 9, wherein the cabinet further includes a control box closely adhered to an inside of the side panel and coupled to the corner frame.

11. The indoor unit according to claim 1, further comprising a support rail installed at a bottom of the cabinet and including a grooved portion with a predetermined width and depth within.

12. An indoor unit of an air conditioner comprising:

a base;

a cabinet including a front panel installed vertically at a front of the base, a side panel installed vertically at a side of the base, a top panel mounted on a top of the front panel and the side panel, and a corner frame for connecting the side panel and the front panel;

a plurality of discharge ports formed in the panels of the cabinet;

at least one ventilation unit installed inside the cabinet and including a fan frame, a fan for suctioning indoor air into the cabinet and a fan discharge port selectively communicating with one of the plurality of discharge ports of the cabinet when the ventilation unit is installed inside the cabinet in a first installation position and selectively communicating with an other of the plurality of discharge ports of the cabinet when the ventilation unit is installed inside the cabinet in a second installation position;

a heat exchanger mounted at an inner rear portion of the cabinet; and a sealing member configured to seal discharge ports of the cabinet that do not communicate with the fan discharge port and being integrally coupled to the frame, wherein the sealing member includes:

a first sealing member integrally coupled to the frame, wherein the first sealing member selectively seals the one of the plurality of discharge ports of the cabinet when the ventilation unit is installed inside the cabinet in the second installation position but not when the ventilation unit is installed inside the cabinet in the first installation position; and a second sealing member integrally coupled to the frame, wherein the first sealing member selectively seals the other of the plurality of discharge ports of the cabinet when the ventilation unit is installed inside the cabinet in the first installation position but not when the ventilation unit is installed inside the cabinet in the second installation position, wherein the first sealing member and the second sealing member are integrally coupled to the frame at the same time.

13. The indoor unit according to claim 12, wherein the plurality of discharge ports includes a discharge port formed on the front panel and a discharge port formed on the top panel, and the set of discharge ports is provided in a number corresponding to a number of ventilation units.

14. The indoor unit according to claim 13, wherein the ventilation units are respectively positioned to correspond to the plurality of discharge ports, and the respective discharge ports of the ventilation units are installed in a same or a different direction.

15. The indoor unit according to claim 12, wherein the side panel is pivotably or detachably coupled to the corner frame.

16. The indoor unit according to claim 12, wherein only the side panel is detachably or pivotably attached to the cabinet for allowing a replacing or a repair of the ventilation unit.

17. The indoor unit according to claim 12, wherein the side panel has a handle installed thereon.

18. The indoor unit according to claim 12, wherein the corner frame has a control box coupled thereto by a flange portion, and the control box has an opening that is sealed by the side panel.

19. The indoor unit according to claim 18, wherein the flange portion includes a flange formed on the corner frame and a flange protruding from either side end of the control box, and the flange formed on the corner frame and the flange protruding from the control box mutually interlock.

20. The indoor unit according to claim 12, wherein the first sealing member is installed at the top of the fan frame for sealing an upper discharge port formed on the top panel and the second sealing member is installed on the lower portion of the fan frame for sealing a front discharge port formed on the front panel, the upper discharge port is sealed by the first sealing member when the ventilation unit is installed on the base panel so that the front discharge port is opened, and the front discharge port is sealed by the second sealing member when the ventilation unit is installed on the base panel so that the upper discharge port is opened.

21. The indoor unit according to claim 12, wherein one of the plurality of discharge ports communicating with the fan discharge port is connected to a duct, and an installation position of the fan frame is changeable to vary the direction of the discharge port according to a connecting location of the duct.

22. The indoor unit according to claim 12, wherein the cabinet and the sealing member are formed to be flush with one another when the sealing member seals one of the plurality of discharge ports.

23. The indoor unit according to claim 1, wherein the motor is an outer rotor-type BLDC motor.

24. The indoor unit according to claim 12, wherein the ventilation unit further includes:

a supporter fixed at an air intake opening side of the fan housing and having the motor installed on an end thereof; and a shaft passing through a center of the motor and connected to the fan.

25. The indoor unit according to claim 24, wherein the supporter further has:

a bearing housing containing a bearing for supporting the shaft passing therethrough;

a fixture arm radially extending from the bearing housing and fixed to a side of the fan housing; and a stator mounting portion formed with a predetermined diameter at a rear of the bearing housing.

26. The indoor unit according to claim 25, further having a vibration absorbing member interposed between the fixture arm and the fan housing.

27. The indoor unit according to claim 24, wherein the motor has a rotor and a stator coupled at an outside of the rotor, the shaft is integrally coupled to the rotor by means of a bushing, and the stator is fixed to an end of the supporter.

28. The indoor unit according to claim 1, further comprising at least one sub ventilation unit including:

a sub fan further connected to the motor by a rotating shaft;

a sub fan housing enclosing the sub fan; and a sub fan frame for supporting the sub fan housing.

29. The indoor unit according to claim 28, wherein the ventilation unit and the at least one sub ventilation unit are respectively installable such that the discharge ports of the fan housings are disposed in a same direction or a mutually different direction.

30. The indoor unit according to claim 12, further comprising:

a control box installed on a side of the side panel;

a fan assembly fastened to an inside of the cabinet;

a motor assembly for driving the fan assembly; and a support rail coupled at a bottom of the base.

31. The indoor unit according to claim 30, wherein a replacing or repairing of the motor assembly includes:

pivoting or disassembling the side panel in a first process;

disassembling the control box in a second process; and disassembling the motor assembly through a side opening of the cabinet in a third process.

32. The indoor unit according to claim 30, wherein the support rail has a u-shaped cross section, and is provided as a pair installed at a predetermined mutually separated distance at a bottom of the base in a left-to-right or a front-to-rear direction.

33. The indoor unit according to claim 30, wherein the fan assembly includes a fan and a fan housing enclosing the fan and having an air intake opening and an air discharge port at sides thereof, and the motor assembly includes a motor supporter coupled to a perimeter of the air intake opening at the side of the fan housing and a motor coupled to an end portion of the motor supporter.

34. The indoor unit according to claim 33, wherein the fan is a sirocco fan.

* * * * *